US010857592B2

(12) United States Patent
Verreault et al.

(10) Patent No.: US 10,857,592 B2
(45) Date of Patent: Dec. 8, 2020

(54) MANIFOLD COLLAR FOR DISTRIBUTING FLUID THROUGH A COLD CRUCIBLE

(71) Applicant: CRUCIBLE INTELLECTUAL PROPERTY, LLC., Rancho Santa Margarita, CA (US)

(72) Inventors: Adam A. Verreault, Dove Canyon, CA (US); Sean T. O'Keeffe, Rancho Santa Margarita, CA (US); Joseph W. Stevick, Rancho Santa Margarita, CA (US)

(73) Assignee: CRUCIBLE INTELLECTUAL PROPERTY, LLC., Rancho Santa Margarita, CA (US)

( * ) Notice: Subject to any disclaimer, the term of this patent is extended or adjusted under 35 U.S.C. 154(b) by 206 days.

(21) Appl. No.: 15/936,199

(22) Filed: Mar. 26, 2018

(65) Prior Publication Data

US 2018/0207717 A1 Jul. 26, 2018

Related U.S. Application Data

(63) Continuation of application No. 13/939,995, filed on Jul. 11, 2013, now Pat. No. 9,925,583.

(51) Int. Cl.
*B22D 17/08* (2006.01)
*B22D 17/10* (2006.01)
(Continued)

(52) U.S. Cl.
CPC ..... *B22D 17/08* (2013.01); *B22D 17/20* (2013.01); *B22D 17/2023* (2013.01);
(Continued)

(58) Field of Classification Search
CPC ..... B22D 17/08; B22D 17/10; B22D 17/12; B22D 17/2038
See application file for complete search history.

(56) References Cited

U.S. PATENT DOCUMENTS 3,671,029 A 6/1972 Kurlsson
3,731,727 A 5/1973 Mitamura et al.
(Continued)

FOREIGN PATENT DOCUMENTS

CA 2010961 3/1997
DE 19902002 7/2000
(Continued)

OTHER PUBLICATIONS

Inoue et al., "Bulk amorphous alloys with high mechanical strength and good soft magnetic properties in Fe—Tm-B(TM=IV-VIII group transition metal) system", Appl. Phys. Lett. vol. 710, p. 464 (1997).
(Continued)

*Primary Examiner* — Kevin E Yoon
(74) *Attorney, Agent, or Firm* — Foley & Lardner LLP

(57) ABSTRACT

Disclosed are embodiments of a temperature regulated vessel and a fluid delivery device, and methods of use thereof. The vessel can be used in an injection molding apparatus and include one or more temperature regulating lines configured to flow a fluid or liquid within the body (e.g., to heat a cold device). The fluid delivery device is mounted in the apparatus and has a collar with an opening extending therethrough to sealingly mate with the vessel. A delivery channel is provided within the collar for directing an input flow of fluid into the vessel. An exit channel can also be provided within the collar for directing an output flow of the fluid from the vessel.

15 Claims, 6 Drawing Sheets

(51) Int. Cl.
*B22D 17/20* (2006.01)
*B22D 17/22* (2006.01)
*F27B 14/08* (2006.01)

(52) U.S. Cl.
CPC ..... *B22D 17/2038* (2013.01); *B22D 17/2227* (2013.01); *F27B 14/08* (2013.01)

(56) References Cited

U.S. PATENT DOCUMENTS

| | | | |
|---|---|---|---|
| 4,135,568 | A | 1/1979 | Brooks |
| 4,265,294 | A | 5/1981 | Gaule |
| 4,612,973 | A | 9/1986 | Whang |
| 4,678,024 | A | 7/1987 | Hull |
| 4,693,299 | A | 9/1987 | Kuznetsov et al. |
| 4,799,532 | A | 1/1989 | Mizuhara |
| 4,887,798 | A | 12/1989 | Julius |
| 5,003,551 | A | 3/1991 | Mortimer |
| 5,055,025 | A | 10/1991 | Muller |
| 5,087,804 | A | 2/1992 | McGaffigne |
| 5,288,344 | A | 2/1994 | Peker et al. |
| 5,368,659 | A | 11/1994 | Peker et al. |
| 5,487,421 | A | 1/1996 | Gerber |
| 5,579,825 | A | 12/1996 | Shibata et al. |
| 5,616,024 | A | 4/1997 | Nobori |
| 5,618,359 | A | 4/1997 | Lin et al. |
| 5,711,363 | A | 1/1998 | Scruggs et al. |
| 5,735,975 | A | 4/1998 | Lin et al. |
| 5,896,642 | A | 4/1999 | Peker |
| 5,960,854 | A | 10/1999 | Fink |
| 5,976,247 | A | 11/1999 | Hansen et al. |
| 6,021,840 | A | 2/2000 | Colvin |
| 6,235,868 | B1 | 5/2001 | Guthrie et al. |
| 6,267,170 | B1 | 7/2001 | Onuki |
| 6,267,171 | B1 | 7/2001 | Onuki |
| 6,283,197 | B1 | 9/2001 | Kono |
| 6,325,868 | B1 | 12/2001 | Kim et al. |
| 6,371,195 | B1 | 4/2002 | Onuki |
| 6,378,597 | B1 | 4/2002 | Zecman |
| 6,427,753 | B1 | 8/2002 | Inoue |
| 6,875,293 | B2 | 4/2005 | Peker |
| 7,017,645 | B2 | 3/2006 | Johnson et al. |
| 7,235,910 | B2 | 6/2007 | Decristofaro et al. |
| 7,377,303 | B2 | 5/2008 | Go |
| 7,401,639 | B2 | 7/2008 | Manda |
| 7,488,170 | B2 | 2/2009 | Yuasa et al. |
| 7,540,929 | B2 | 6/2009 | Demetriou et al. |
| 7,575,040 | B2 | 8/2009 | Johnson |
| 7,708,844 | B2 | 5/2010 | Muramatsu |
| 7,906,219 | B2 | 3/2011 | Ohara |
| 8,066,827 | B2 | 11/2011 | Demetriou et al. |
| 8,361,250 | B2 | 1/2013 | Demetriou et al. |
| 2002/0005233 | A1 | 1/2002 | Schrirra et al. |
| 2005/0028961 | A1 | 2/2005 | Toyoshima et al. |
| 2005/0155738 | A1* | 7/2005 | Squires ..... B22D 17/08 164/312 |
| 2005/0242454 | A1 | 11/2005 | Yuasa et al. |
| 2006/0042773 | A1 | 3/2006 | Eisen |
| 2006/0254747 | A1 | 11/2006 | Lshida et al. |
| 2006/0291529 | A1 | 12/2006 | Haun et al. |
| 2007/0079907 | A1 | 4/2007 | Johnson et al. |
| 2008/0118387 | A1 | 5/2008 | Demetriou et al. |
| 2008/0305387 | A1 | 12/2008 | Murray et al. |
| 2009/0236494 | A1 | 9/2009 | Hata et al. |
| 2010/0084052 | A1 | 4/2010 | Farmer et al. |
| 2010/0098967 | A1 | 4/2010 | Schroers |
| 2010/0300148 | A1 | 12/2010 | Demetriou et al. |
| 2011/0011750 | A1 | 1/2011 | Lovens |
| 2011/0108231 | A1 | 5/2011 | Zheng et al. |
| 2012/0111522 | A1 | 5/2012 | Bullied et al. |

FOREIGN PATENT DOCUMENTS

| | | |
|---|---|---|
| EP | 0845316 | 6/1998 |
| EP | 1013363 | 6/2000 |
| EP | 1415740 | 5/2004 |
| FR | 2665654 | 2/1992 |
| GB | 392764 | 5/1933 |
| GB | 574914 | 1/1946 |
| GB | 784363 | 10/1957 |
| JP | 55036033 | 3/1980 |
| JP | 6212205 | 8/1994 |
| JP | 8013111 | 1/1996 |
| JP | A H09174219 | 7/1997 |
| JP | A H09239518 | 9/1997 |
| JP | 9272929 | 10/1997 |
| JP | H11104804 | 4/1999 |
| JP | 2000024767 | 1/2000 |
| JP | 2000326065 | 11/2000 |
| JP | 2001071113 | 3/2001 |
| JP | 2001259821 | 9/2001 |
| JP | 2001303218 | 10/2001 |
| JP | A 2003145260 | 5/2003 |
| JP | 2004050269 | 2/2004 |
| JP | 2006289466 | 10/2006 |
| JP | 2009068101 | 4/2009 |
| JP | 2009172627 | 8/2009 |
| JP | 2009173964 | 8/2009 |
| JP | 2010036210 | 2/2010 |
| WO | WO0037201 | 6/2000 |
| WO | WO2005004559 | 1/2005 |
| WO | WO2006127792 | 11/2006 |
| WO | WO2008046219 | 4/2008 |
| WO | WO2009067512 | 5/2009 |
| WO | WO2010108744 | 9/2010 |
| WO | WO2010111701 | 9/2010 |

OTHER PUBLICATIONS

Shen et al., 01., "Bulk Glassy C043Fe20Ta5.5B31.5 Alloy with High Glass-Forming Ability and Good Soft Magnetic Properties", Materials Transactions, vol. 42 No. 1 O (2001) pp. 2136-2139.

International Search Report issued in PCT/US2011 /052354, dated Mar. 16, 2012.

International Search Report issued in PCT/US2011 /054153, dated Jun. 13, 2012.

Wolf, S.; R.N. Tauber (1986),Silicon Processing for the VLSI Era: vol. 1—Process Technoloav. Lattice Press. pp. 531-534, 546.

Walker, Perrin; William H. Tam (1991 ), CRC Handbook of Metal Etchants. pp. 287-291.

Kohler, Michael (1999). Etchina in Microsystem Technoloay. John Wiley & Son Ltd. p. 329.

McDeavitt et al., "High Temperature Interaction Behavior at Liquid Metal-Ceramic Interfaces", Journal of Materials Enaineerina and Performance, vol. 11, Aug. 2002.

Kargahi et al., "Analysis of failure of conducting crucible used in induction metal", Aug. 1988.

Inoue et al., "Microstructure and Properties of Bulky Al84Ni10Ce6 Alloys with Amorphous Surface Layer Prepared by High-Pressure Die Casting", Materials Transactions, Jim, vol. 35, No. 11 (1994), pp. 808-813.

* cited by examiner

MANIFOLD COLLAR FOR DISTRIBUTING FLUID THROUGH A COLD CRUCIBLE

CROSS-REFERENCE TO RELATED APPLICATIONS

This application is a Continuation of U.S. patent application Ser. No. 13/939,995 (now U.S. Pat. No. 9,925,583), filed Jul. 11, 2013, the entire disclosure of which is hereby incorporated by reference for any and all purposes.

FIELD

The present disclosure is generally related to delivery of fluid to parts of an inline injection system. More specifically, it relates to a device used to direct fluid to at least a vessel in the system for temperature regulation thereof.

BACKGROUND

Cold hearth melting systems may be used to melt a metal or an alloy. The container can be designed to include a coolant system to force-cool the container and absorb heat during the heating/melting process, or heat the container before it used for melting. Examples of cooling and melting techniques for melting materials include skull melting (also known as cold wall induction melting), plasma hearth melting/plasma arc melting, and electron beam melting. All of these techniques may be used to process reactive metals such as titanium, zirconium, hafnium, and beryllium and alloys thereof, for example. Some injection molding machines use an induction coil to melt material in a vessel or boat before injecting the material into a mold. Such vessels or boats can utilize temperature regulating techniques as well.

When melting such materials, water (or other suitable liquid or fluid) may be used to transfer heat between the molten material and the container base itself. Some machines use copper tubing to deliver the water. Such tubing typically has to be bent or deformed and shaped around a selected container or vessel after it is installed. When containers are replaced, the tubing typically also has to be moved and sometimes replaced and again bent or deformed and shaped around the selected container.

SUMMARY

A proposed solution according to embodiments herein for delivering fluid (e.g., to a vessel) in an inline injection apparatus or system when melting materials.

In accordance with various embodiments, there is provided a device having a collar having an opening extending therethrough; and a delivery channel within the collar for directing an input flow of fluid. The collar is configured to sealingly mate with a temperature regulated vessel via the opening. The delivery channel is configured to deliver the input flow of the fluid into the temperature regulated vessel. In an embodiment, an exit channel is provided within the collar for directing an output flow of the fluid. The exit channel is configured to output the output flow of the fluid from the temperature regulated vessel.

In accordance with various embodiments, there is provided an apparatus. The apparatus can include: a vessel configured to receive a material for melting therein; a heat source for melting the material in the vessel; a coolant system; and a fluid delivery device for delivering fluid from the coolant system. The fluid delivery device has a collar with an opening extending therethrough and a delivery channel within the collar for directing an input flow of the fluid. The delivery channel is configured to deliver the input flow of the fluid into the vessel. The vessel is provided in the opening of the collar and sealed thereto. The vessel has one or more temperature regulating channels configured to flow the fluid therein received by the delivery channel for regulating a temperature of the vessel during melting of the material by the heat source. In an embodiment, an exit channel is provided within the collar for directing an output flow of the fluid. The exit channel is configured to output the output flow of the fluid from the temperature regulated vessel.

In accordance with various embodiments, there is provided a method. The method can include: delivering fluid from a coolant system to a fluid delivery device; directing the fluid using the fluid delivery device to an end of a vessel; operating a heat source provided adjacent to the vessel to heat a meltable material therein; and regulating a temperature of the vessel by flowing the fluid within the vessel. The fluid delivery device has a collar with an opening extending therethrough and a circumferential delivery channel within the collar for directing an input flow of the fluid. The delivery channel is configured to deliver the input flow of the fluid into the vessel. The vessel is provided in the opening of the collar and sealed thereto. The vessel has one or more temperature regulating channels configured to flow the fluid therein received by the delivery channel for regulating a temperature of the vessel during the operation of the heat source. In an embodiment, an exit channel is provided within the collar for directing an output flow of the fluid. The exit channel is configured to output the output flow of the fluid from the temperature regulated vessel. The method can include directing the output flow of the fluid from the vessel to the coolant system using the fluid delivery device.

Also, in accordance with embodiments, the material for melting in a vessel comprises a BMG feedstock, and a BMG part may be formed.

DETAILED DESCRIPTION

All publications, patents, and patent applications cited in this Specification are hereby incorporated by reference in their entirety.

The articles "a" and "an" are used herein to refer to one or to more than one (i.e., to at least one) of the grammatical object of the article. By way of example, "a polymer resin" means one polymer resin or more than one polymer resin. Any ranges cited herein are inclusive. The terms "substantially" and "about" used throughout this Specification are used to describe and account for small fluctuations. For example, they can refer to less than or equal to ±5%, such as less than or equal to ±2%, such as less than or equal to ±1%, such as less than or equal to ±0.5%, such as less than or equal to ±0.2%, such as less than or equal to ±0.1%, such as less than or equal to ±0.05%.

Bulk-solidifying amorphous alloys, or bulk metallic glasses ("BMG"), are a recently developed class of metallic materials. These alloys may be solidified and cooled at relatively slow rates, and they retain the amorphous, non-crystalline (i.e., glassy) state at room temperature. Amorphous alloys have many superior properties than their crystalline counterparts. However, if the cooling rate is not sufficiently high, crystals may form inside the alloy during cooling, so that the benefits of the amorphous state can be lost. For example, one challenge with the fabrication of bulk amorphous alloy parts is partial crystallization of the parts due to either slow cooling or impurities in the raw alloy material. As a high degree of amorphicity (and, conversely, a low degree of crystallinity) is desirable in BMG parts, there is a need to develop methods for casting BMG parts having controlled amount of amorphicity.

Figure 1:
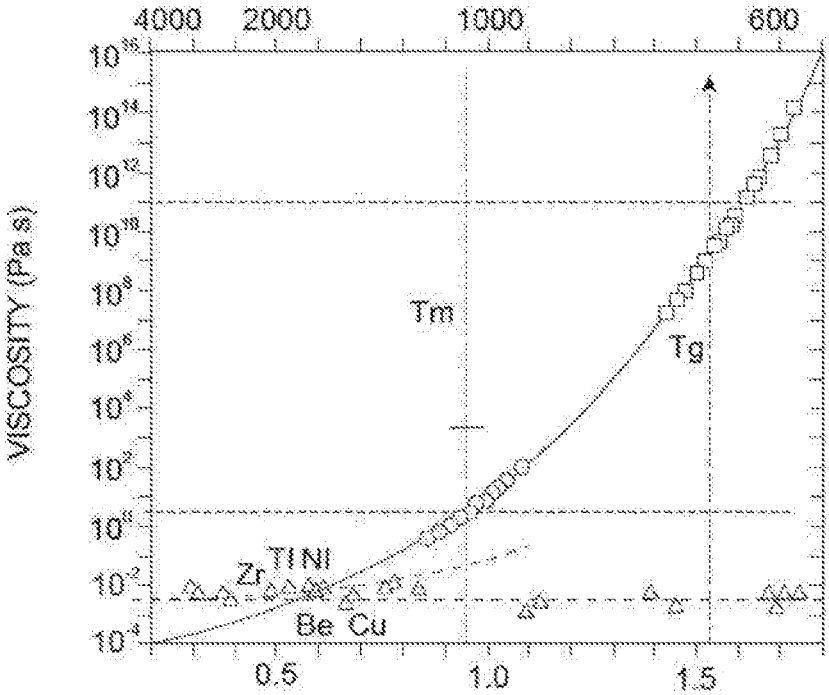
FIGURE 1 PRIOR ART
FIG. 1 provides a temperature-viscosity diagram of an exemplary bulk solidifying amorphous alloy.

FIG. 1 (obtained from U.S. Pat. No. 7,575,040) shows a viscosity-temperature graph of an exemplary bulk solidifying amorphous alloy, from the VIT-001 series of Zr—Ti—Ni—Cu—Be family manufactured by Liquidmetal Technology. It should be noted that there is no clear liquid/solid transformation for a bulk solidifying amorphous metal during the formation of an amorphous solid. The molten alloy becomes more and more viscous with increasing undercooling until it approaches solid form around the glass transition temperature. Accordingly, the temperature of solidification front for bulk solidifying amorphous alloys can be around glass transition temperature, where the alloy will practically act as a solid for the purposes of pulling out the quenched amorphous sheet product.

Figure 2:
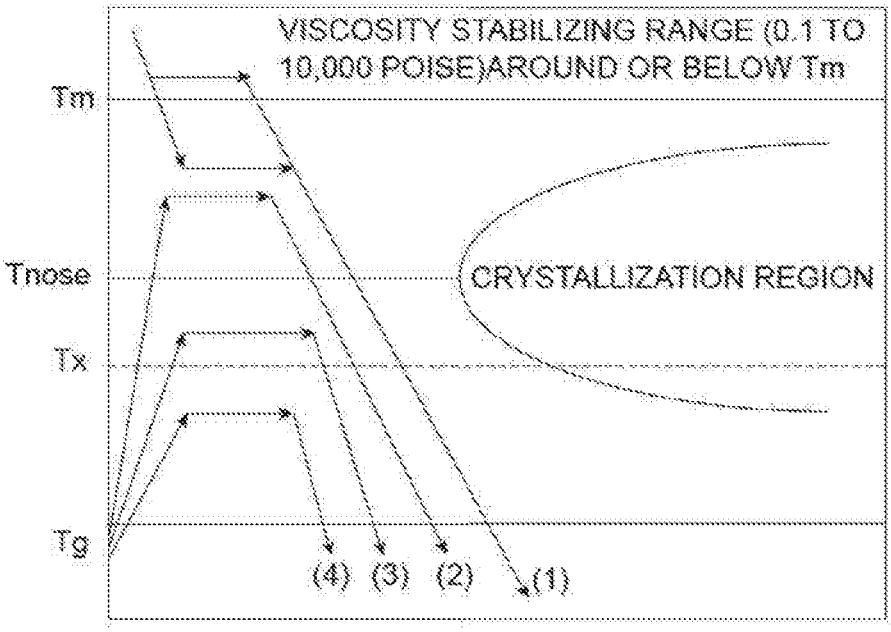
FIGURE 2 PRIOR ART
FIG. 2 provides a schematic of a time-temperature-transformation (TTT) diagram for an exemplary bulk solidifying amorphous alloy.

FIG. 2 (obtained from U.S. Pat. No. 7,575,040) shows the time-temperature-transformation (TTT) cooling curve of an exemplary bulk solidifying amorphous alloy, or TTT diagram. Bulk-solidifying amorphous metals do not experience a liquid/solid crystallization transformation upon cooling, as with conventional metals. Instead, the highly fluid, non crystalline form of the metal found at high temperatures (near a "melting temperature" Tm) becomes more viscous as the temperature is reduced (near to the glass transition temperature Tg), eventually taking on the outward physical properties of a conventional solid.

Even though there is no liquid/crystallization transformation for a bulk solidifying amorphous metal, a "melting temperature" Tm may be defined as the thermodynamic liquidus temperature of the corresponding crystalline phase. Under this regime, the viscosity of bulk-solidifying amorphous alloys at the melting temperature could lie in the range of about 0.1 poise to about 10,000 poise, and even sometimes under 0.01 poise. A lower viscosity at the "melting temperature" would provide faster and complete filling of intricate portions of the shell/mold with a bulk solidifying amorphous metal for forming the BMG parts. Furthermore, the cooling rate of the molten metal to form a BMG part has to such that the time-temperature profile during cooling does not traverse through the nose-shaped region bounding the crystallized region in the TTT diagram of FIG. 2. In FIG. 2, Tnose is the critical crystallization temperature Tx where crystallization is most rapid and occurs in the shortest time scale.

The supercooled liquid region, the temperature region between Tg and Tx is a manifestation of the extraordinary stability against crystallization of bulk solidification alloys. In this temperature region the bulk solidifying alloy can exist as a high viscous liquid. The viscosity of the bulk solidifying alloy in the supercooled liquid region can vary between $10^{12}$ Pa s at the glass transition temperature down to $10^{5}$ Pa s at the crystallization temperature, the high temperature limit of the supercooled liquid region. Liquids with such viscosities can undergo substantial plastic strain under an applied pressure. The embodiments herein make use of the large plastic formability in the supercooled liquid region as a forming and separating method.

One needs to clarify something about Tx. Technically, the nose-shaped curve shown in the TTT diagram describes Tx as a function of temperature and time. Thus, regardless of the trajectory that one takes while heating or cooling a metal alloy, when one hits the TTT curve, one has reached Tx. In FIG. 2, Tx is shown as a dashed line as Tx can vary from close to Tm to close to Tg.

The schematic TTT diagram of FIG. 2 shows processing methods of die casting from at or above Tm to below Tg without the time-temperature trajectory (shown as (1) as an example trajectory) hitting the TTT curve. During die casting, the forming takes place substantially simultaneously with fast cooling to avoid the trajectory hitting the TTT curve. The processing methods for superplastic forming (SPF) from at or below Tg to below Tm without the time-temperature trajectory (shown as (2), (3) and (4) as example trajectories) hitting the TTT curve. In SPF, the amorphous BMG is reheated into the supercooled liquid region where the available processing window could be much larger than die casting, resulting in better controllability of the process. The SPF process does not require fast cooling to avoid crystallization during cooling. Also, as shown by example trajectories (2), (3) and (4), the SPF can be carried out with the highest temperature during SPF being above Tnose or below Tnose, up to about Tm. If one heats up a piece of amorphous alloy but manages to avoid hitting the TTT curve, you have heated "between Tg and Tm", but one would have not reached Tx.

Typical differential scanning calorimeter (DSC) heating curves of bulk-solidifying amorphous alloys taken at a heating rate of 20 C/min describe, for the most part, a particular trajectory across the TTT data where one would likely see a Tg at a certain temperature, a Tx when the DSC heating ramp crosses the TTT crystallization onset, and eventually melting peaks when the same trajectory crosses the temperature range for melting. If one heats a bulk-solidifying amorphous alloy at a rapid heating rate as shown by the ramp up portion of trajectories (2), (3) and (4) in FIG. 2, then one could avoid the TTT curve entirely, and the DSC data would show a glass transition but no Tx upon heating. Another way to think about it is trajectories (2), (3) and (4) can fall anywhere in temperature between the nose of the TTT curve (and even above it) and the Tg line, as long as it does not hit the crystallization curve. That just means that the horizontal plateau in trajectories might get much shorter as one increases the processing temperature.

Phase

The term "phase" herein can refer to one that can be found in a thermodynamic phase diagram. A phase is a region of space (e.g., a thermodynamic system) throughout which all physical properties of a material are essentially uniform. Examples of physical properties include density, index of refraction, chemical composition and lattice periodicity. A simple description of a phase is a region of material that is chemically uniform, physically distinct, and/or mechanically separable. For example, in a system consisting of ice and water in a glass jar, the ice cubes are one phase, the water is a second phase, and the humid air over the water is a third phase. The glass of the jar is another separate phase. A phase can refer to a solid solution, which can be a binary, tertiary, quaternary, or more, solution, or a compound, such as an intermetallic compound. As another example, an amorphous phase is distinct from a crystalline phase.

Metal, Transition Metal, and Non-Metal

The term "metal" refers to an electropositive chemical element. The term "element" in this Specification refers generally to an element that can be found in a Periodic Table. Physically, a metal atom in the ground state contains a partially filled band with an empty state close to an occupied state. The term "transition metal" is any of the metallic elements within Groups 3 to 12 in the Periodic Table that have an incomplete inner electron shell and that serve as transitional links between the most and the least electropositive in a series of elements. Transition metals are characterized by multiple valences, colored compounds, and the ability to form stable complex ions. The term "nonmetal" refers to a chemical element that does not have the capacity to lose electrons and form a positive ion.

Depending on the application, any suitable nonmetal elements, or their combinations, can be used. The alloy (or "alloy composition") can include multiple nonmetal elements, such as at least two, at least three, at least four, or more, nonmetal elements. A nonmetal element can be any element that is found in Groups 13-17 in the Periodic Table. For example, a nonmetal element can be any one of F, Cl, Br, I, At, O, S, Se, Te, Po, N, P, As, Sb, Bi, C, Si, Ge, Sn, Pb, and B. Occasionally, a nonmetal element can also refer to certain metalloids (e.g., B, Si, Ge, As, Sb, Te, and Po) in Groups 13-17. In one embodiment, the nonmetal elements can include B, Si, C, P, or combinations thereof. Accordingly, for example, the alloy can include a boride, a carbide, or both.

A transition metal element can be any of scandium, titanium, vanadium, chromium, manganese, iron, cobalt, nickel, copper, zinc, yttrium, zirconium, niobium, molybdenum, technetium, ruthenium, rhodium, palladium, silver, cadmium, hafnium, tantalum, tungsten, rhenium, osmium, iridium, platinum, gold, mercury, rutherfordium, dubnium, seaborgium, bohrium, hassium, meitnerium, ununnilium, unununium, and ununbium. In one embodiment, a BMG containing a transition metal element can have at least one of Sc, Y, La, Ac, Ti, Zr, Hf, V, Nb, Ta, Cr, Mo, W, Mn, Tc, Re, Fe, Ru, Os, Co, Rh, Ir, Ni, Pd, Pt, Cu, Ag, Au, Zn, Cd, and Hg. Depending on the application, any suitable transitional metal elements, or their combinations, can be used. The alloy composition can include multiple transitional metal elements, such as at least two, at least three, at least four, or more, transitional metal elements.

The presently described alloy or alloy "sample" or "specimen" alloy can have any shape or size. For example, the alloy can have a shape of a particulate, which can have a shape such as spherical, ellipsoid, wire-like, rod-like, sheet-like, flake-like, or an irregular shape. The particulate can have any size. For example, it can have an average diameter of between about 1 micron and about 100 microns, such as between about 5 microns and about 80 microns, such as between about 10 microns and about 60 microns, such as between about 15 microns and about 50 microns, such as between about 15 microns and about 45 microns, such as between about 20 microns and about 40 microns, such as between about 25 microns and about 35 microns. For example, in one embodiment, the average diameter of the particulate is between about 25 microns and about 44 microns. In some embodiments, smaller particulates, such as those in the nanometer range, or larger particulates, such as those bigger than 100 microns, can be used.

The alloy sample or specimen can also be of a much larger dimension. For example, it can be a bulk structural component, such as an ingot, housing/casing of an electronic device or even a portion of a structural component that has dimensions in the millimeter, centimeter, or meter range.

Solid Solution

The term "solid solution" refers to a solid form of a solution. The term "solution" refers to a mixture of two or more substances, which may be solids, liquids, gases, or a combination of these. The mixture can be homogeneous or heterogeneous. The term "mixture" is a composition of two or more substances that are combined with each other and are generally capable of being separated. Generally, the two or more substances are not chemically combined with each other.

Alloy

In some embodiments, the alloy composition described herein can be fully alloyed. In one embodiment, an "alloy" refers to a homogeneous mixture or solid solution of two or more metals, the atoms of one replacing or occupying interstitial positions between the atoms of the other; for example, brass is an alloy of zinc and copper. An alloy, in contrast to a composite, can refer to a partial or complete solid solution of one or more elements in a metal matrix, such as one or more compounds in a metallic matrix. The term alloy herein can refer to both a complete solid solution alloy that can give single solid phase microstructure and a partial solution that can give two or more phases. An alloy composition described herein can refer to one comprising an alloy or one comprising an alloy-containing composite.

Thus, a fully alloyed alloy can have a homogenous distribution of the constituents, be it a solid solution phase, a compound phase, or both. The term "fully alloyed" used herein can account for minor variations within the error tolerance. For example, it can refer to at least 90% alloyed, such as at least 95% alloyed, such as at least 99% alloyed, such as at least 99.5% alloyed, such as at least 99.9% alloyed. The percentage herein can refer to either volume percent or weight percentage, depending on the context. These percentages can be balanced by impurities, which can be in terms of composition or phases that are not a part of the alloy.

Amorphous or Non-Crystalline Solid

An "amorphous" or "non-crystalline solid" is a solid that lacks lattice periodicity, which is characteristic of a crystal. As used herein, an "amorphous solid" includes "glass" which is an amorphous solid that softens and transforms into a liquid-like state upon heating through the glass transition. Generally, amorphous materials lack the long-range order characteristic of a crystal, though they can possess some short-range order at the atomic length scale due to the nature of chemical bonding. The distinction between amorphous solids and crystalline solids can be made based on lattice periodicity as determined by structural characterization techniques such as x-ray diffraction and transmission electron microscopy.

The terms "order" and "disorder" designate the presence or absence of some symmetry or correlation in a manyparticle system. The terms "long-range order" and "short-range order" distinguish order in materials based on length scales.

The strictest form of order in a solid is lattice periodicity: a certain pattern (the arrangement of atoms in a unit cell) is repeated again and again to form a translationally invariant tiling of space. This is the defining property of a crystal. Possible symmetries have been classified in 14 Bravais lattices and 230 space groups.

Lattice periodicity implies long-range order. If only one unit cell is known, then by virtue of the translational symmetry it is possible to accurately predict all atomic positions at arbitrary distances. The converse is generally true, except, for example, in quasi-crystals that have perfectly deterministic tilings but do not possess lattice periodicity.

Long-range order characterizes physical systems in which remote portions of the same sample exhibit correlated behavior. This can be expressed as a correlation function, namely the spin-spin correlation function: $G(x,x')=\langle s(x),s(x')\rangle$.

In the above function, s is the spin quantum number and x is the distance function within the particular system. This function is equal to unity when $x=x'$ and decreases as the distance $|x-x'|$ increases. Typically, it decays exponentially to zero at large distances, and the system is considered to be disordered. If, however, the correlation function decays to a constant value at large $|x-x'|$, then the system can be said to possess long-range order. If it decays to zero as a power of the distance, then it can be called quasi-long-range order. Note that what constitutes a large value of $|x-x'|$ is relative.

A system can be said to present quenched disorder when some parameters defining its behavior are random variables that do not evolve with time (i.e., they are quenched or frozen)—e.g., spin glasses. It is opposite to annealed disorder, where the random variables are allowed to evolve themselves. Embodiments herein include systems comprising quenched disorder.

The alloy described herein can be crystalline, partially crystalline, amorphous, or substantially amorphous. For example, the alloy sample/specimen can include at least some crystallinity, with grains/crystals having sizes in the nanometer and/or micrometer ranges. Alternatively, the alloy can be substantially amorphous, such as fully amorphous. In one embodiment, the alloy composition is at least substantially not amorphous, such as being substantially crystalline, such as being entirely crystalline.

In one embodiment, the presence of a crystal or a plurality of crystals in an otherwise amorphous alloy can be construed as a "crystalline phase" therein. The degree of crystallinity (or "crystallinity" for short in some embodiments) of an alloy can refer to the amount of the crystalline phase present in the alloy. The degree can refer to, for example, a fraction of crystals present in the alloy. The fraction can refer to volume fraction or weight fraction, depending on the context. A measure of how "amorphous" an amorphous alloy is can be amorphicity. Amorphicity can be measured in terms of a degree of crystallinity. For example, in one embodiment, an alloy having a low degree of crystallinity can be said to have a high degree of amorphicity. In one embodiment, for example, an alloy having 60 vol % crystalline phase can have a 40 vol % amorphous phase.

Amorphous Alloy or Amorphous Metal

An "amorphous alloy" is an alloy having an amorphous content of more than 50% by volume, preferably more than 90% by volume of amorphous content, more preferably more than 95% by volume of amorphous content, and most preferably more than 99% to almost 100% by volume of amorphous content. Note that, as described above, an alloy high in amorphicity is equivalently low in degree of crystallinity. An "amorphous metal" is an amorphous metal material with a disordered atomic-scale structure. In contrast to most metals, which are crystalline and therefore have a highly ordered arrangement of atoms, amorphous alloys are non-crystalline. Materials in which such a disordered structure is produced directly from the liquid state during cooling are sometimes referred to as "glasses." Accordingly, amorphous metals are commonly referred to as "metallic glasses" or "glassy metals." In one embodiment, a bulk metallic glass ("BMG") can refer to an alloy, of which the microstructure is at least partially amorphous. However, there are several ways besides extremely rapid cooling to produce amorphous metals, including physical vapor deposition, solid-state reaction, ion irradiation, melt spinning, and mechanical alloying. Amorphous alloys can be a single class of materials, regardless of how they are prepared.

Amorphous metals can be produced through a variety of quick-cooling methods. For instance, amorphous metals can be produced by sputtering molten metal onto a spinning metal disk. The rapid cooling, on the order of millions of degrees a second, can be too fast for crystals to form, and the material is thus "locked in" a glassy state. Also, amorphous metals/alloys can be produced with critical cooling rates low enough to allow formation of amorphous structures in thick layers—e.g., bulk metallic glasses.

The terms "bulk metallic glass" ("BMG"), bulk amorphous alloy ("BAA"), and bulk solidifying amorphous alloy are used interchangeably herein. They refer to amorphous alloys having the smallest dimension at least in the millimeter range. For example, the dimension can be at least about 0.5 mm, such as at least about 1 mm, such as at least about 2 mm, such as at least about 4 mm, such as at least about 5 mm, such as at least about 6 mm, such as at least about 8 mm, such as at least about 10 mm, such as at least about 12 mm. Depending on the geometry, the dimension can refer to the diameter, radius, thickness, width, length, etc. A BMG can also be a metallic glass having at least one dimension in the centimeter range, such as at least about 1.0 cm, such as at least about 2.0 cm, such as at least about 5.0 cm, such as at least about 10.0 cm. In some embodiments, a BMG can have at least one dimension at least in the meter range. A BMG can take any of the shapes or forms described above, as related to a metallic glass. Accordingly, a BMG described herein in some embodiments can be different from a thin film made by a conventional deposition technique in one important aspect—the former can be of a much larger dimension than the latter.

Amorphous metals can be an alloy rather than a pure metal. The alloys may contain atoms of significantly different sizes, leading to low free volume (and therefore having viscosity up to orders of magnitude higher than other metals and alloys) in a molten state. The viscosity prevents the atoms from moving enough to form an ordered lattice. The material structure may result in low shrinkage during cooling and resistance to plastic deformation. The absence of grain boundaries, the weak spots of crystalline materials in some cases, may, for example, lead to better resistance to wear and corrosion. In one embodiment, amorphous metals, while technically glasses, may also be much tougher and less brittle than oxide glasses and ceramics.

Thermal conductivity of amorphous materials may be lower than that of their crystalline counterparts. To achieve formation of an amorphous structure even during slower cooling, the alloy may be made of three or more components, leading to complex crystal units with higher potential energy and lower probability of formation. The formation of amorphous alloy can depend on several factors: the composition of the components of the alloy; the atomic radius of the components (preferably with a significant difference of over 12% to achieve high packing density and low free volume); and the negative heat of mixing the combination of components, inhibiting crystal nucleation and prolonging the time the molten metal stays in a supercooled state. However, as the formation of an amorphous alloy is based on many different variables, it can be difficult to make a prior determination of whether an alloy composition would form an amorphous alloy.

Amorphous alloys, for example, of boron, silicon, phosphorus, and other glass formers with magnetic metals (iron, cobalt, nickel) may be magnetic, with low coercivity and high electrical resistance. The high resistance leads to low losses by eddy currents when subjected to alternating magnetic fields, a property useful, for example, as transformer magnetic cores.

Amorphous alloys may have a variety of potentially useful properties. In particular, they tend to be stronger than crystalline alloys of similar chemical composition, and they can sustain larger reversible ("elastic") deformations than crystalline alloys. Amorphous metals derive their strength directly from their non-crystalline structure, which can have none of the defects (such as dislocations) that limit the strength of crystalline alloys. For example, one modern amorphous metal, known as Vitreloy™, has a tensile strength that is almost twice that of high-grade titanium. In some embodiments, metallic glasses at room temperature are not ductile and tend to fail suddenly when loaded in tension, which limits the material applicability in reliability-critical applications, as the impending failure is not evident. Therefore, to overcome this challenge, metal matrix composite materials having a metallic glass matrix containing dendritic particles or fibers of a ductile crystalline metal can be used. Alternatively, a BMG low in element(s) that tend to cause embitterment (e.g., Ni) can be used. For example, a Ni-free BMG can be used to improve the ductility of the BMG.

Another useful property of bulk amorphous alloys is that they can be true glasses; in other words, they can soften and flow upon heating. This can allow for easy processing, such as by injection molding, in much the same way as polymers. As a result, amorphous alloys can be used for making sports equipment, medical devices, electronic components and equipment, and thin films. Thin films of amorphous metals can be deposited as protective coatings via a high velocity oxygen fuel technique.

A material can have an amorphous phase, a crystalline phase, or both. The amorphous and crystalline phases can have the same chemical composition and differ only in the microstructure—i.e., one amorphous and the other crystalline. Microstructure in one embodiment refers to the structure of a material as revealed by a microscope at 25× magnification or higher. Alternatively, the two phases can have different chemical compositions and microstructures. For example, a composition can be partially amorphous, substantially amorphous, or completely amorphous.

As described above, the degree of amorphicity (and conversely the degree of crystallinity) can be measured by fraction of crystals present in the alloy. The degree can refer to volume fraction of weight fraction of the crystalline phase present in the alloy. A partially amorphous composition can refer to a composition of at least about 5 vol % of which is of an amorphous phase, such as at least about 10 vol %, such as at least about 20 vol %, such as at least about 40 vol %, such as at least about 60 vol %, such as at least about 80 vol %, such as at least about 90 vol %. The terms "substantially" and "about" have been defined elsewhere in this application. Accordingly, a composition that is at least substantially amorphous can refer to one of which at least about 90 vol % is amorphous, such as at least about 95 vol %, such as at least about 98 vol %, such as at least about 99 vol %, such as at least about 99.5 vol %, such as at least about 99.8 vol %, such as at least about 99.9 vol %. In one embodiment, a substantially amorphous composition can have some incidental, insignificant amount of crystalline phase present therein.

In one embodiment, an amorphous alloy composition can be homogeneous with respect to the amorphous phase. A substance that is uniform in composition is homogeneous. This is in contrast to a substance that is heterogeneous. The term "composition" refers to the chemical composition and/or microstructure in the substance. A substance is homogeneous when a volume of the substance is divided in half and both halves have substantially the same composition. For example, a particulate suspension is homogeneous when a volume of the particulate suspension is divided in half and both halves have substantially the same volume of particles. However, it might be possible to see the individual particles under a microscope. Another example of a homogeneous substance is air where different ingredients therein are equally suspended, though the particles, gases and liquids in air can be analyzed separately or separated from air.

A composition that is homogeneous with respect to an amorphous alloy can refer to one having an amorphous phase substantially uniformly distributed throughout its microstructure. In other words, the composition macroscopically includes a substantially uniformly distributed amorphous alloy throughout the composition. In an alternative embodiment, the composition can be of a composite, having an amorphous phase having therein a non-amorphous phase. The non-amorphous phase can be a crystal or a plurality of crystals. The crystals can be in the form of particulates of any shape, such as spherical, ellipsoid, wire-like, rod-like, sheet-like, flake-like, or an irregular shape. In one embodiment, it can have a dendritic form. For example, an at least partially amorphous composite composition can have a crystalline phase in the shape of dendrites dispersed in an amorphous phase matrix; the dispersion can be uniform or non-uniform, and the amorphous phase and the crystalline phase can have the same or a different chemical composition. In one embodiment, they have substantially the same chemical composition. In another embodiment, the crystalline phase can be more ductile than the BMG phase.

The methods described herein can be applicable to any type of amorphous alloy. Similarly, the amorphous alloy described herein as a constituent of a composition or article can be of any type. The amorphous alloy can include the element Zr, Hf, Ti, Cu, Ni, Pt, Pd, Fe, Mg, Au, La, Ag, Al, Mo, Nb, Be, or combinations thereof. Namely, the alloy can include any combination of these elements in its chemical formula or chemical composition. The elements can be present at different weight or volume percentages. For example, an iron "based" alloy can refer to an alloy having a non-insignificant weight percentage of iron present therein, the weight percent can be, for example, at least about 20 wt %, such as at least about 40 wt %, such as at least about 50 wt %, such as at least about 60 wt %, such as at least about 80 wt %. Alternatively, in one embodiment, the above-described percentages can be volume percentages, instead of weight percentages. Accordingly, an amorphous alloy can be zirconium-based, titanium-based, platinum-based, palladium-based, gold-based, silver-based, copper-based, iron-based, nickel-based, aluminum-based, molybdenum-based, and the like. The alloy can also be free of any of the aforementioned elements to suit a particular purpose. For example, in some embodiments, the alloy, or the composition including the alloy, can be substantially free of nickel, aluminum, titanium, beryllium, or combinations thereof. In one embodiment, the alloy or the composite is completely free of nickel, aluminum, titanium, beryllium, or combinations thereof.

For example, the amorphous alloy can have the formula $(Zr, Ti)_a(Ni, Cu, Fe)_b(Be, Al, Si, B)_c$, wherein a, b, and c each represents a weight or atomic percentage. In one embodiment, a is in the range of from 30 to 75, b is in the range of from 5 to 60, and c is in the range of from 0 to 50 in atomic percentages. Alternatively, the amorphous alloy can have the formula $(Zr, Ti)_a(Ni, Cu)_b(Be)_C$, wherein a, b, and c each represents a weight or atomic percentage. In one embodiment, a is in the range of from 40 to 75, b is in the range of from 5 to 50, and c is in the range of from 5 to 50 in atomic percentages. The alloy can also have the formula $(Zr, Ti)_a(Ni, Cu)_b(Be)_c$, wherein a, b, and c each represents a weight or atomic percentage. In one embodiment, a is in the range of from 45 to 65, b is in the range of from 7.5 to 35, and c is in the range of from 10 to 37.5 in atomic percentages. Alternatively, the alloy can have the formula $(Zr)_a(Nb, Ti)_b(Ni, Cu)_c(Al)_d$, wherein a, b, c, and d each represents a weight or atomic percentage. In one embodiment, a is in the range of from 45 to 65, b is in the range of from 0 to 10, c is in the range of from 20 to 40 and d is in the range of from 7.5 to 15 in atomic percentages. One exemplary embodiment of the aforedescribed alloy system is a Zr—Ti—Ni—Cu—Be based amorphous alloy under the trade name Vitreloy™, such as Vitreloy-1 and Vitreloy-101, as fabricated by Liquidmetal Technologies, CA, USA. Some examples of amorphous alloys of the different systems are provided in Table 1 and Table 2.

TABLE 1

Exemplary amorphous alloy compositions

| Alloy | Atm % | Atm % | Atm % | Atm % | Atm % | Atm % | Atm % | Atm % |
|---|---|---|---|---|---|---|---|---|
| 1 | Fe | Mo | Ni | Cr | P | C | B | |
| | 68.00% | 5.00% | 5.00% | 2.00% | 12.50% | 5.00% | 2.50% | |
| 2 | Fe | Mo | Ni | Cr | P | C | B | Si |
| | 68.00% | 5.00% | 5.00% | 2.00% | 11.00% | 5.00% | 2.50% | 1.50% |
| 3 | Pd | Cu | Co | P | | | | |
| | 44.48% | 32.35% | 4.05% | 19.11% | | | | |
| 4 | Pd | Ag | Si | P | | | | |
| | 77.50% | 6.00% | 9.00% | 7.50% | | | | |
| 5 | Pd | Ag | Si | P | Ge | | | |
| | 79.00% | 3.50% | 9.50% | 6.00% | 2.00% | | | |
| 6 | Pt | Cu | Ag | P | B | Si | | |
| | 74.70% | 1.50% | 0.30% | 18.0% | 4.00% | 1.50% | | |

TABLE 2

Additional Exemplary amorphous alloy compositions (atomic %)

| Alloy | Atm % | Atm % | Atm % | Atm % | Atm % | Atm % |
|---|---|---|---|---|---|---|
| 1 | Zr | Ti | Cu | Ni | Be | |
| | 41.20% | 13.80% | 12.50% | 10.00% | 22.50% | |
| 2 | Zr | Ti | Cu | Ni | Be | |
| | 44.00% | 11.00% | 10.00% | 10.00% | 25.00% | |
| 3 | Zr | Ti | Cu | Ni | Nb | Be |
| | 56.25% | 11.25% | 6.88% | 5.63% | 7.50% | 12.50% |

TABLE 2-continued

Additional Exemplary amorphous alloy compositions (atomic %)

| Alloy | Atm % | Atm % | Atm % | Atm % | Atm % | Atm % |
|---|---|---|---|---|---|---|
| 4 | Zr | Ti | Cu | Ni | Al | Be |
| | 64.75% | 5.60% | 14.90% | 11.15% | 2.60% | 1.00% |
| 5 | Zr | Ti | Cu | Ni | Al | |
| | 52.50% | 5.00% | 17.90% | 14.60% | 10.00% | |
| 6 | Zr | Nb | Cu | Ni | Al | |
| | 57.00% | 5.00% | 15.40% | 12.60% | 10.00% | |
| 7 | Zr | Cu | Ni | Al | | |
| | 50.75% | 36.23% | 4.03% | 9.00% | | |
| 8 | Zr | Ti | Cu | Ni | Be | |
| | 46.75% | 8.25% | 7.50% | 10.00% | 27.50% | |
| 9 | Zr | Ti | Ni | Be | | |
| | 21.67% | 43.33% | 7.50% | 27.50% | | |
| 10 | Zr | Ti | Cu | Be | | |
| | 35.00% | 30.00% | 7.50% | 27.50% | | |
| 11 | Zr | Ti | Co | Be | | |
| | 35.00% | 30.00% | 6.00% | 29.00% | | |
| 12 | Zr | Ti | Fe | Be | | |
| | 35.00% | 30.00% | 2.00% | 33.00% | | |
| 13 | Au | Ag | Pd | Cu | Si | |
| | 49.00% | 5.50% | 2.30% | 26.90% | 16.30% | |
| 14 | Au | Ag | Pd | Cu | Si | |
| | 50.90% | 3.00% | 2.30% | 27.80% | 16.00% | |
| 15 | Pt | Cu | Ni | P | | |
| | 57.50% | 14.70% | 5.30% | 22.50% | | |
| 16 | Zr | Ti | Nb | Cu | Be | |
| | 36.60% | 31.40% | 7.00% | 5.90% | 19.10% | |
| 17 | Zr | Ti | Nb | Cu | Be | |
| | 38.30% | 32.90% | 7.30% | 6.20% | 15.30% | |
| 18 | Zr | Ti | Nb | Cu | Be | |
| | 39.60% | 33.90% | 7.60% | 6.40% | 12.50% | |
| 19 | Cu | Ti | Zr | Ni | | |
| | 47.00% | 34.00% | 11.00% | 8.00% | | |
| 20 | Zr | Co | Al | | | |
| | 55.00% | 25.00% | 20.00% | | | |

Other exemplary ferrous metal-based alloys include compositions such as those disclosed in U.S. Patent Application Publication Nos. 2007/0079907 and 2008/0305387. These compositions include the Fe(Mn, Co, Ni, Cu) (C, Si, B, P, Al) system, wherein the Fe content is from 60 to 75 atomic percentage, the total of (Mn, Co, Ni, Cu) is in the range of from 5 to 25 atomic percentage, and the total of (C, Si, B, P, Al) is in the range of from 8 to 20 atomic percentage, as well as the exemplary composition Fe48Cr15Mo14Y2C15B6. They also include the alloy systems described by Fe—Cr—Mo—(Y,Ln)-C—B, Co—Cr—Mo-Ln-C—B, Fe—Mn—Cr—Mo—(Y,Ln)-C—B, (Fe, Cr, Co)—(Mo,Mn)—(C,B)—Y, Fe—(Co,Ni)—(Zr,Nb,Ta)—(Mo,W)—B, Fe—(Al,Ga)—(P,C,B,Si,Ge), Fe—(Co, Cr,Mo,Ga,Sb)—P—B—C, (Fe, Co)—B—Si—Nb alloys, and Fe—(Cr—Mo)—(C,B)—Tm, where Ln denotes a lanthanide element and Tm denotes a transition metal element. Furthermore, the amorphous alloy can also be one of the exemplary compositions Fe80P12.5C5B2.5, Fe80P11C5B2.5Si1.5, Fe74.5Mo5.5P12.5C5B2.5, Fe74.5Mo5.5P11C5B2.5Si1.5, Fe70Mo5Ni5P12.5C5B2.5, Fe70Mo5Ni5P11C5B2.5Si1.5, Fe68Mo5Ni5Cr2P12.5C5B2.5, and Fe68Mo5Ni5Cr2P11C5B2.5Si1.5, described in U.S. Patent Application Publication No. 2010/0300148.

The amorphous alloys can also be ferrous alloys, such as (Fe, Ni, Co) based alloys. Examples of such compositions are disclosed in U.S. Pat. Nos. 6,325,868; 5,288,344; 5,368,659; 5,618,359; and 5,735,975, Inoue et al., Appl. Phys. Lett., Volume 71, p 464 (1997), Shen et al., Mater. Trans., JIM, Volume 42, p 2136 (2001), and Japanese Patent Application No. 200126277 (Pub. No. 2001303218 A). One exemplary composition is $Fe_{72}Al_5Ga_2P_{II}C_6B_4$. Another example is $Fe_{72}Al_7Zr_{10}Mo_5W_2B_{15}$. Another iron-based alloy system that can be used in the coating herein is disclosed in U.S. Patent Application Publication No. 2010/0084052, wherein the amorphous metal contains, for example, manganese (1 to 3 atomic %), yttrium (0.1 to 10 atomic %), and silicon (0.3 to 3.1 atomic %) in the range of composition given in parentheses; and that contains the following elements in the specified range of composition given in parentheses: chromium (15 to 20 atomic %), molybdenum (2 to 15 atomic %), tungsten (1 to 3 atomic %), boron (5 to 16 atomic %), carbon (3 to 16 atomic %), and the balance iron.

The amorphous alloy can also be one of the Pt- or Pd-based alloys described by U.S. Patent Application Publication Nos. 2008/0135136, 2009/0162629, and 2010/0230012. Exemplary compositions include Pd44.48Cu32.35Co4.05P19.11, Pd77.5Ag6Si9P7.5, and Pt74.7Cu1.5Ag0.3P18B4Si1.5.

The aforedescribed amorphous alloy systems can further include additional elements, such as additional transition metal elements, including Nb, Cr, V, and Co. The additional elements can be present at less than or equal to about 30 wt %, such as less than or equal to about 20 wt %, such as less than or equal to about 10 wt %, such as less than or equal to about 5 wt %. In one embodiment, the additional, optional element is at least one of cobalt, manganese, zirconium, tantalum, niobium, tungsten, yttrium, titanium, vanadium and hafnium to form carbides and further improve wear and corrosion resistance. Further optional elements may include phosphorous, germanium and arsenic, totaling up to about 2%, and preferably less than 1%, to reduce melting point. Otherwise incidental impurities should be less than about 2% and preferably 0.5%.

In some embodiments, a composition having an amorphous alloy can include a small amount of impurities. The impurity elements can be intentionally added to modify the properties of the composition, such as improving the mechanical properties (e.g., hardness, strength, fracture mechanism, etc.) and/or improving the corrosion resistance. Alternatively, the impurities can be present as inevitable, incidental impurities, such as those obtained as a byproduct of processing and manufacturing. The impurities can be less than or equal to about 10 wt %, such as about 5 wt %, such as about 2 wt %, such as about 1 wt %, such as about 0.5 wt %, such as about 0.1 wt %. In some embodiments, these percentages can be volume percentages instead of weight percentages. In one embodiment, the alloy sample/composition consists essentially of the amorphous alloy (with only a small incidental amount of impurities). In another embodiment, the composition includes the amorphous alloy (with no observable trace of impurities).

In one embodiment, the final parts exceeded the critical casting thickness of the bulk solidifying amorphous alloys.

In embodiments herein, the existence of a supercooled liquid region in which the bulk-solidifying amorphous alloy can exist as a high viscous liquid allows for superplastic forming. Large plastic deformations can be obtained. The ability to undergo large plastic deformation in the supercooled liquid region is used for the forming and/or cutting process. As oppose to solids, the liquid bulk solidifying alloy deforms locally which drastically lowers the required energy for cutting and forming. The ease of cutting and forming depends on the temperature of the alloy, the mold, and the cutting tool. As higher is the temperature, the lower is the viscosity, and consequently easier is the cutting and forming.

Embodiments herein can utilize a thermoplastic-forming process with amorphous alloys carried out between Tg and Tx, for example. Herein, Tx and Tg are determined from standard DSC measurements at typical heating rates (e.g. 20° C./min) as the onset of crystallization temperature and the onset of glass transition temperature.

The amorphous alloy components can have the critical casting thickness and the final part can have thickness that is thicker than the critical casting thickness. Moreover, the time and temperature of the heating and shaping operation is selected such that the elastic strain limit of the amorphous alloy could be substantially preserved to be not less than 1.0%, and preferably not being less than 1.5%. In the context of the embodiments herein, temperatures around glass transition means the forming temperatures can be below glass transition, at or around glass transition, and above glass transition temperature, but preferably at temperatures below the crystallization temperature $T_x$. The cooling step is carried out at rates similar to the heating rates at the heating step, and preferably at rates greater than the heating rates at the heating step. The cooling step is also achieved preferably while the forming and shaping loads are still maintained.

Electronic Devices

The embodiments herein can be valuable in the fabrication of electronic devices using a BMG. An electronic device herein can refer to any electronic device known in the art. For example, it can be a telephone, such as a cell phone, and a land-line phone, or any communication device, such as a smart phone, including, for example an iPhone™, and an electronic email sending/receiving device. It can be a part of a display, such as a digital display, a TV monitor, an electronic-book reader, a portable web-browser (e.g., iPad™), and a computer monitor. It can also be an entertainment device, including a portable DVD player, conventional DVD player, Blu-Ray disk player, video game console, music player, such as a portable music player (e.g., iPod™), etc. It can also be a part of a device that provides control, such as controlling the streaming of images, videos, sounds (e.g., Apple TV™), or it can be a remote control for an electronic device. It can be a part of a computer or its accessories, such as the hard drive tower housing or casing, laptop housing, laptop keyboard, laptop track pad, desktop keyboard, mouse, and speaker. The article can also be applied to a device such as a watch or a clock.

The methods, techniques, and devices illustrated herein are not intended to be limited to the illustrated embodiments. As disclosed herein, an apparatus or a system (or a device or a machine) is configured to perform melting of and injection molding of material(s) (such as amorphous alloys). The apparatus is configured to process such materials or alloys by melting at higher melting temperatures before injecting the molten material into a mold for molding. Delivery of fluid (e.g., water) is directed to parts of the machine to regulate and/or cool the parts during at least the melting process. A device is used in the apparatus to direct fluid delivery. As further described below and shown in the Figures, parts of the apparatus are positioned in-line with each other. In accordance with some embodiments, parts of the apparatus (or access thereto) are aligned on a horizontal axis. The following embodiments are for illustrative purposes only and are not meant to be limiting.

In accordance with various embodiments, there is provided a device having a collar having an opening extending therethrough; and a delivery channel within the collar for directing an input flow of fluid. The collar is configured to sealingly mate with a temperature regulated vessel via the opening. The delivery channel is configured to deliver the input flow of the fluid into the temperature regulated vessel. In an embodiment, an exit channel is provided within the collar for directing an output flow of the fluid. The exit channel is configured to output the output flow of the fluid from the temperature regulated vessel.

In accordance with various embodiments, there is provided an apparatus. The apparatus can include: a vessel configured to receive a material for melting therein; a heat source for melting the material in the vessel; a coolant system; and a fluid delivery device for delivering fluid from the coolant system. The fluid delivery device has a collar with an opening extending therethrough and a delivery channel within the collar for directing an input flow of the fluid. The delivery channel is configured to deliver the input flow of the fluid into the vessel. The vessel is provided in the opening of the collar and sealed thereto. The vessel has one or more temperature regulating channels configured to flow the fluid therein received by the delivery channel for regulating a temperature of the vessel during melting of the material by the heat source. In an embodiment, an exit channel is provided within the collar for directing an output flow of the fluid. The exit channel is configured to output the output flow of the fluid from the temperature regulated vessel.

In accordance with various embodiments, there is provided a method. The method can include: delivering fluid from a coolant system to a fluid delivery device; directing the fluid using the fluid delivery device to an end of a vessel; operating a heat source provided adjacent to the vessel to heat a meltable material therein; and regulating a temperature of the vessel by flowing the fluid within the vessel. The fluid delivery device has a collar with an opening extending therethrough and a circumferential delivery channel within the collar for directing an input flow of the fluid. The delivery channel is configured to deliver the input flow of the fluid into the vessel. The vessel is provided in the opening of the collar and sealed thereto. The vessel has one or more temperature regulating channels configured to flow the fluid therein received by the delivery channel for regulating a temperature of the vessel during the operation of the heat source. In an embodiment, an exit channel is provided within the collar for directing an output flow of the fluid. The exit channel is configured to output the output flow of the fluid from the temperature regulated vessel. The method can include directing the output flow of the fluid from the vessel to the coolant system using the fluid delivery device.

Figure 3:
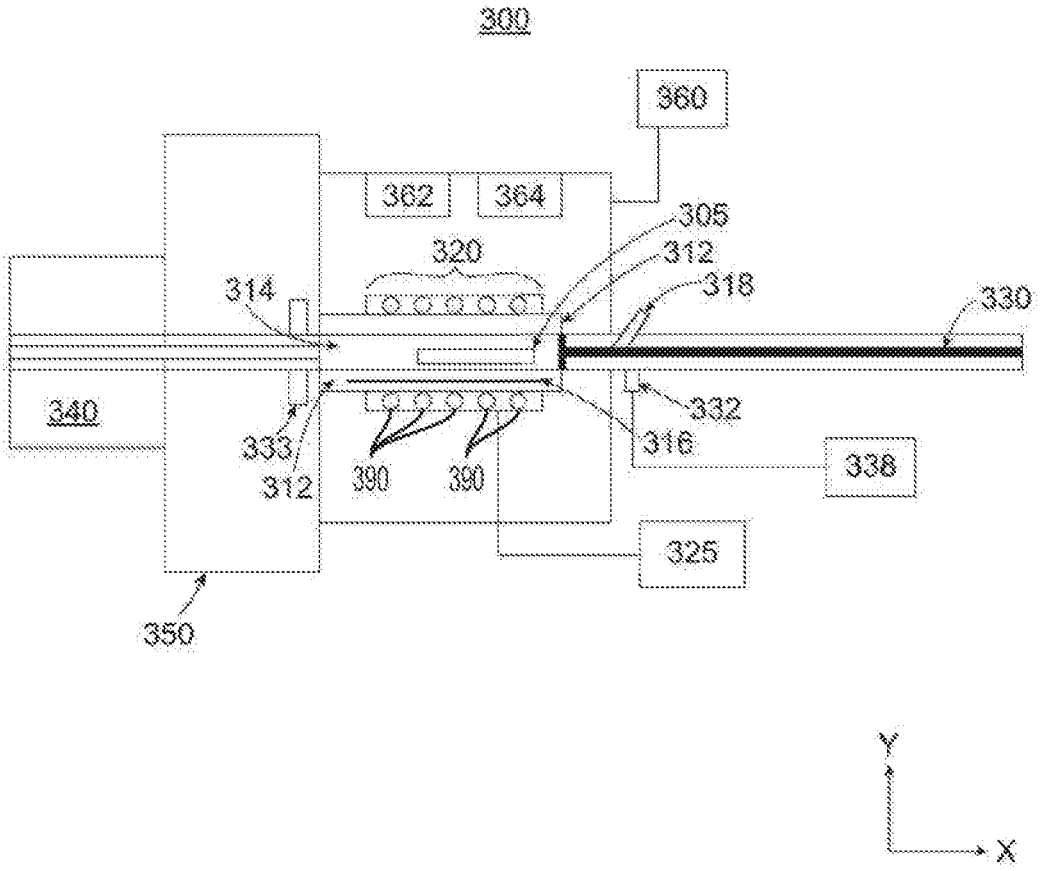
FIG. 3 shows a schematic diagram of an exemplary injection molding system/apparatus in accordance with various embodiments of the present teachings.

FIG. 3 illustrates a schematic diagram of such an exemplary apparatus. More specifically, FIG. 3 illustrates an injection molding apparatus 300. In accordance with an embodiment, injection molding system 300 can include a melt zone with an induction coil 320 configured to melt meltable material 305 received therein, and at least one plunger rod 330 configured to eject molten material 305 from the melt zone and into a mold 340. In an embodiment, at least plunger rod 330 and the melt zone are provided in-line and on a horizontal axis (e.g., X axis), such that plunger rod 330 is moved in a horizontal direction (e.g., along the X-axis) substantially through the melt zone to move the molten material 305 into mold 340. In The mold can be positioned adjacent to the melt zone.

Melt zone 310 includes a melting mechanism configured to receive meltable material and to hold the material as it is heated to a molten state. The melting mechanism may be in the form of a vessel 312, for example, that has a body for receiving meltable material and configured to melt the material therein. Vessel 312 may have an inlet for inputting material (e.g., feedstock) into a receiving or melting portion 314 of its body. The body of the vessel has a length and can extend in a longitudinal and horizontal direction, as shown in FIG. 3, such that molten material is removed horizontally therefrom using plunger 330. The material for heating or melting may be received in a melting portion 314 of the vessel 312. Melting portion 314 is configured to receive meltable material to be melted therein within the melt zone of the apparatus. For example, melting portion 314 has a surface for receiving material.

A vessel as used throughout this disclosure is a container or body made of a material employed for heating substances to high temperatures. The vessel can also act as a shot sleeve for moving molten material towards a mold. In an embodiment, vessel 312 is a cold hearth melting device that is configured to be utilized for meltable material(s) while under a vacuum (e.g., applied by a vacuum device or pump at a vacuum port 332) and exposed or heat via an induction source (e.g., coil).

In an embodiment, a body of the vessel and/or its melting portion 314 may include substantially rounded and/or smooth surfaces. For example, a surface of melting portion 314 may be formed in an arcuate, a round, or a circular shape. However, the shape and/or surfaces of the body are not meant to be limiting. The body may be an integral structure, or formed from separate parts that are joined or machined together.

In an embodiment, the body of vessel 312 is configured to receive the plunger rod 330 therethrough in a horizontal direction to move the molten material. That is, in an embodiment, the melting mechanism is on the same axis as the plunger rod, and the body can be configured and/or sized to receive at least part of the plunger rod. Thus, plunger rod 330 can be configured to move molten material (after heating/melting) from the vessel by moving substantially through vessel 312, and into a mold 340. Referencing the illustrated embodiment of apparatus 300 in FIG. 3, for example, plunger rod 330 would move in a horizontal direction from the right towards the left, through vessel 312, moving and pushing the molten material towards and into mold 340.

To heat melt zone 310 and melt the meltable material received in vessel 312, injection apparatus 300 also includes a heat source that is used to heat and melt the meltable material. At least melting portion 314 of the vessel, if not substantially the entire body itself, is configured to be heated such that the material received therein is melted. Heating is accomplished using, for example, an induction source 320 positioned within melt zone 310 that is configured to melt the meltable material. In an embodiment, induction source 320 is positioned adjacent vessel 312. For example, induction source 320 may be in the form of a coil positioned in a helical manner substantially around a length of the vessel body. However, other configurations or patterns that are configured to melt material within the vessel 312 can be used. As such, vessel 312 may be configured to inductively melt a meltable material (e.g., an inserted ingot 305) within melting portion 314 by supplying a magnetic field to the meltable material resulting from power being applied induction source/coil 320, using a power supply or source 325. Thus, the melt zone can include an induction zone. Induction coil 320 is configured to heat up and melt any material that is contained by vessel 312 without melting and wetting vessel 312. Induction coil 320 emits radiofrequency (RF) waves towards vessel 312 which generates a magnetic field for melting the material therein. As shown, the body and coil 320 surrounding vessel 312 may be configured for positioning in a horizontal direction along a horizontal axis (e.g., X axis). In an embodiment, the induction coil 320 is positioned in a horizontal configuration such that its turns are positioned around and adjacent the vessel 312.

In an embodiment, the vessel 312 is a temperature regulated vessel. Such a vessel 312 may include one or more temperature regulating channels 316 or coolant lines configured to flow a gas or a liquid (e.g., water, oil, or other fluid) therein for regulating a temperature of the body of vessel 312 during melting of material in the vessel (e.g., to force cool the vessel, or to heat the vessel 312 before melting), during application of the induction field (via the induction source or coil). Such a vessel can also be provided on the same axis as the plunger rod 330. The channel(s) 316 can assist in preventing excessive heating and melting of the body of the vessel 312 itself, or to supply heat to the body of the vessel 312 when working with a cold device. Regulating channel(s) 316 may be connected to a coolant system 360 configured to induce flow of a gas or a liquid in the vessel. The regulating channel(s) 316 may include one or more inlets and outlets for the fluid to flow there-through. The inlets and outlets of the channels 316 may be configured in any number of ways and are not meant to be limited. For example, channel(s) 316 may be positioned relative to melting portion 314 such that material thereon is melted and the vessel temperature is regulated (i.e., heat is absorbed, and the vessel is cooled), or so that heat is transferred to the vessel before melting (i.e., so that the vessel surface is warmed or heated, e.g., to reduce cooling/heat transfer from the meltable material). The number, positioning and/or direction of the regulating channel(s) should not be limited. The liquid or fluid may be configured to flow through the regulating channel(s) during melting of the meltable material, when induction source 320 is powered.

In an embodiment, temperature regulating channels can be provided in other parts of the system. For example, in an embodiment, additional channels may be provided around or adjacent the induction source 320. In an embodiment, temperature regulating channels may be provided in the mold 340. Accordingly, though regulating channels throughout this disclosure are described with reference to vessel 312, it should be understood that alternative and/or additional channels configured to flow fluid therein can be provided in an apparatus to regulating temperature of other or additional parts (of the system or apparatus) at least during a melting process (e.g., when induction source 320 is powered and induction field is applied).

Figure 10:
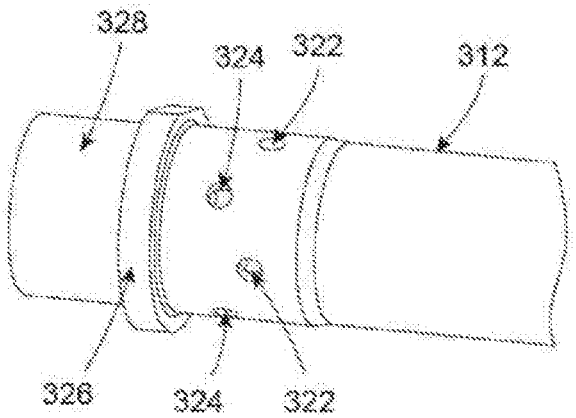
FIG. 10 illustrates a detailed view of an end of the vessel shown in FIG. 4.

FIG. 10 shows a partial view of an end of temperature regulated vessel 312 that has a substantially tubular structure in accordance with an embodiment. The vessel 312 can be configured for positioning along a horizontal axis for use in an injection apparatus with a horizontally positioned induction coil 320. The vessel 312 has a melting portion 314 therein that is configured to receive meltable material for melting by a magnetic field from induction coil 320 provided adjacent to the vessel.

The vessel shown in FIG. 10 has temperature regulating channels that are configured to allow for a flow of a liquid (e.g., water, or other fluid) in a longitudinal direction therein when placed in a longitudinal and horizontal direction in the apparatus 300. However, the direction of the regulating channels within and along its body is not intended to be limiting. In an embodiment, the channel(s) 316 may be positioned in a horizontal or lateral direction.

The regulating channel(s) may include one or more fluid inlets 322 and outlets 324 for the liquid or fluid to flow therethrough. As shown in FIG. 10, the inlets 322 and outlets 324 can be provided adjacent connection end 328 of its body 328. The inlets 322 and outlets 324 can be holes or openings provided around the perimeter of its body. The inlets 322 and outlets 324 are configured to communicate with a coolant system to input and output a fluid into and out of the regulating channel(s). The inlets 322 and outlets 324 can be positioned radially relative to a center axis of the vessel 312 (as shown), despite the configuration of the regulating line(s). In an embodiment, as shown in FIG. 10, inlets 322 and outlets 324 are offset or staggered relative to one another. For example, the inlets 322 may be provided radially and circumferentially around the body in a spaced configuration in a first area (e.g., to the right in FIG. 10), and the outlets 324 may be provided radially and circumferentially around the body in a spaced configuration in a second area (e.g., to the right in FIG. 10). In an embodiment, a position of the inlets and outlets can be based on a position of the regulating channel(s).

The inlets and outlets of the regulating channels may be configured in any number of ways and are not meant to be limited. Further, a direction of flow of fluid or liquid within the channel(s) is not limiting. For example, in an embodiment, the fluid may be configured to enter and exit each channel such that the liquid flows in one direction. In another embodiment, the liquid may be configured to flow in alternate directions, e.g., each adjacent line may include an alternating entrance and exit. The fluid or liquid can be configured to flow into the inlets 322 and longitudinally along a first side of the body, for example, and flow longitudinally along a second side of the body in an opposite direction, in each of the channels, and out of the outlets 324. The direction of flow within each channel need not be the same. In addition, the regulating channels may be configured to have one or more entrances/exits that are configured to allow flow of the liquid between the channels. For example, in an embodiment wherein a vessel comprises longitudinally extending regulating channels, one or more of the channels may include one or more lateral or extending line(s) that extend to another channel(s) or line(s) such that they are fluidly joined to each other. That is, the liquid can be configured to not only run longitudinally along the body, but also through and between connected channel(s).

The number, positioning, flow within, and/or direction of the regulating channels in the vessel 312. Also, the shape and/or size (e.g., diameter or width) of the inlets 322 and outlets 324 and/or the regulating channels is not limited. The size of the inlets 322 and/or outlets 324 may be based on the number of regulating channels included in the body, for example, or the size of the segment or material the channels are provided in (e.g., based on a thickness of a surface, such as the thickness of the body). The size of the regulating channels may also be based on an amount of desired cooling or heating.

Figure 5:
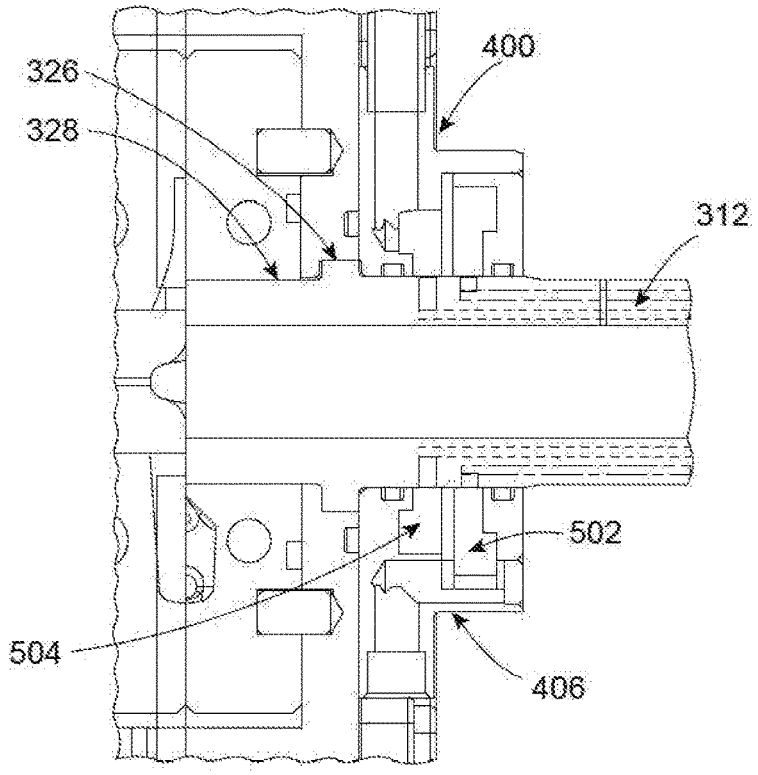
FIG. 5 illustrates a detailed view of the device shown in FIG. 4.

FIG. 10 also shows that the vessel 312 has a flange 326. The flange 326 is configured to secure connection end 328 of the vessel body within an injection molding apparatus, as shown in FIG. 5. The flange 326 prevents movement of the body relative to the injection molding apparatus. The flange 326 can prevent the vessel 312 from being pulled out during injection. For example, as a plunger 330 moves molten material from the vessel and injects it into a mold, its body is subject to force as the injection process takes place. As the cavity of the mold is filling via forward pressure from the plunger 330, some back pressure can be transferred to the vessel. Flange 326 aids in stabilizing and holding the vessel in the apparatus.

The flange 326 can be in the form of a protruding rim, edge, rib, or collar. It is used to strengthen the body of the vessel, hold it in place, and/or attach it to another object in an injection molding apparatus. In an embodiment, instead of a flange 326, the vessel 312 can include a groove adjacent its connection end 328. A ring can be provided to sit in the groove. The combination of the ring and groove can be used to secure the vessel in a similar manner as the flange.

Figure 4:
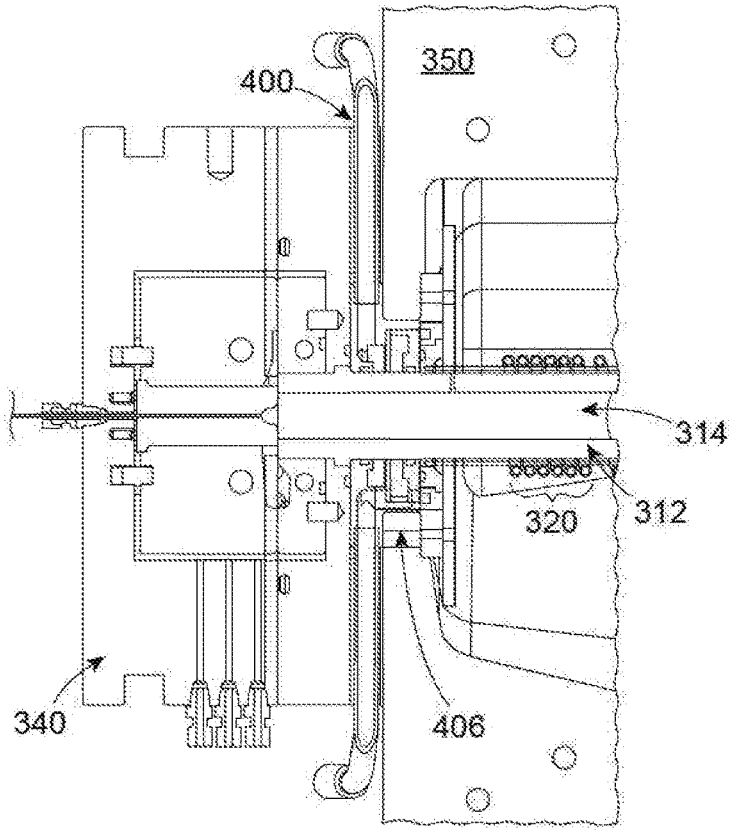
FIG. 4 illustrates a sectional view of a device installed in an injection molding apparatus in accordance with an embodiment of this disclosure.

As shown in FIG. 4, the flange 326 is configured for insertion on a mold side 340 of the apparatus (as opposed to the plunger side). As shown in FIG. 5, the connection end 328 can be aligned in and inserted into mold 340. In an embodiment, the flange 326 of vessel 312 is configured for positioning and securement in a surface of the mold 340. This may be adjacent to a transfer sleeve 350, for example. The positioning of the vessel 312 as shown in FIGS. 4 and 5 can allow for transfer and injection of molten material from the melting portion 314 of the vessel 312, after a melting process, in a horizontal direction into the mold 340. Plunger 330 can be used to move and inject the molten material, for example.

In some cases, when a melt system is part of an inline injection apparatus, vessels made of certain materials may need to be replaced after a period of time because of mechanical instability. Such vessels may not be produced and designed for precision and repeatability at low cost of manufacturing. Some coolant systems use tubing that is positioned relative to the body of the vessel to deliver fluid, and may include bending or deforming the tubing in the area of the melt zone 310. When vessels are replaced, tubing used to deliver fluid from the coolant system 360 has to be moved and sometimes replaced and again.

In an embodiment, to deliver fluid to apparatus 300, e.g., to temperature regulating channels of vessel 312, a device 400 can be provided. The device 400 is a fluid delivery device, or manifold, used for delivering fluid from the coolant system 360 to at least the vessel 312. In an embodiment, shown in FIG. 4, the device 400 is configured for positioning and securement between a mold 340 and a transfer sleeve 350, for example.

Figure 6:
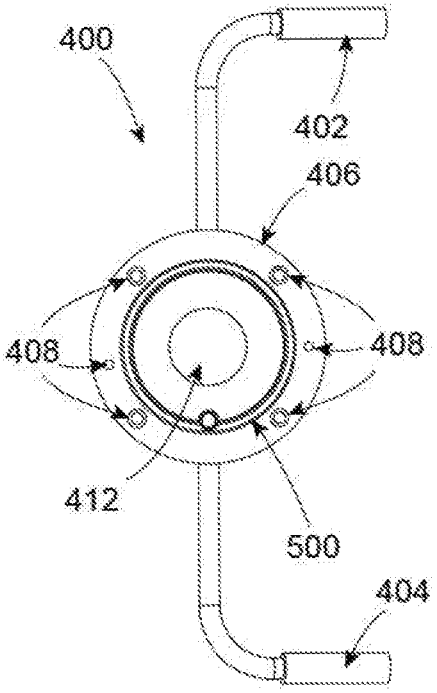
FIGS. 6 and 7 illustrate side and front views of the device in accordance with an embodiment.
Figure 7:
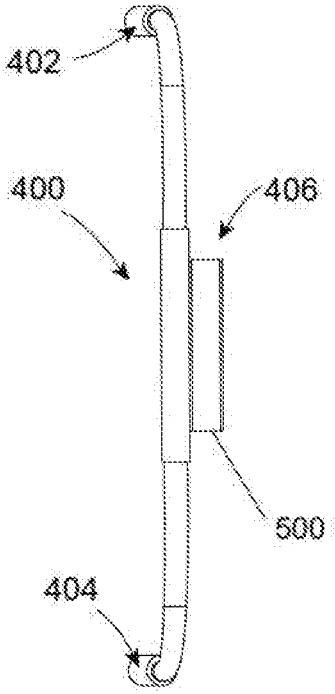
Figure 9:
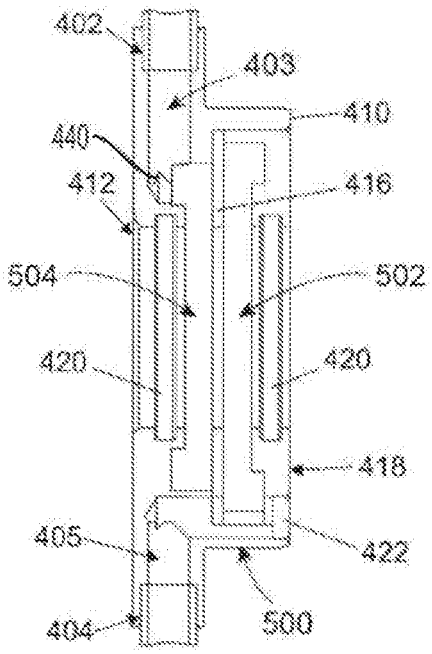
FIG. 9 illustrates a detailed view of a section of the device in accordance with an embodiment.

FIGS. 6 and 7 illustrate front and side views of the device 400, in accordance with an embodiment. The device 400 has a collar 406 having an opening 412 extending therethrough. The collar 406 is configured to sealingly mate with a vessel, such as vessel 316 shown in FIG. 10, via the opening 412. The vessel 316 is provided in the opening 412 of the collar 406 and sealed thereto. In an embodiment, as shown in FIG. 9, a central axis of the opening 412 is provided through a center of the collar 406. Accordingly, the body of the vessel 312 can be inserted through the opening 412 such that a connection end 328 and flange 326 can be secured in the mold 340.

In an embodiment, the device 400 is attached to the mold 340 in the injection molding apparatus 300. The device can include an attachment portion with holes 408 positioned therein. Holes 408 may be alignment pin holes and/or through holes, for example. Fasteners or bolts can be inserted through one or more of the holes 408 and secured to a base or surface of the mold 340. By attaching the device 400 to the mold 340, the device 400 is configured to move with the mold 340 and/or other parts of the machine. Since the device 400 moves with the mold 340, service to parts of the apparatus is simplified. Parts can be serviced on the mold side of the machine. For example, a vessel 312 can be replaced, if needed. Also, the device 400 can be serviced or replaced easily when needed.

In an embodiment, the collar 406 has a body 500, as shown in FIG. 7. The body 500 may extend from the attachment portion, for example.

Within the body 500 of the collar 406 there is a delivery channel 502, as seen in FIG. 9, for directing an input flow of fluid. In this disclosure, "channel" is defined as a course into which fluid or liquid (e.g., water) may be directed. In accordance with an embodiment, the delivery channel 502 is configured to deliver the input flow of the fluid from a coolant system into a mated vessel. More specifically, as depicted in FIG. 5, fluid is delivered by delivery channel 502 into one or more aligned inlets 322 of the vessel 312. In an embodiment, the delivery channel 502 is configured around the opening 412.

In an embodiment, the delivery channel is a circumferential channel within the collar 406. For example, the delivery channel 502 can be configured around the opening 412. A circumferential delivery channel 502 can deliver fluid around an adjacent portion of the body of the vessel that has inlets 322 provided in a spaced and circumferential configuration. If the inlets 322 to the temperature regulating lines of the vessel are positioned radially, such as shown in FIG. 10, the circumferential delivery channel 502 can feed fluid to each inlet 322 and thus regulating channel of the vessel. This configuration provides a compact design and reduces costs associated with machining a vessel. It also allows for different inlet configurations as well; that is, the inlets 322 of the regulating channels can be provided at different radial positions because despite the angles of the inlets 322 (relative to the regulating channels in the vessel), the inlets 322 can receive fluid via the collar 406, so as long as the delivery channel 502 and the inlets 322 are positioned for alignment when the vessel is sealed within the collar 406.

In an embodiment, there may be an exit channel 504 provided within the collar 406, as seen in FIG. 9 (provided on a left side relative to the delivery channel 502), for directing an output flow of fluid. In accordance with an embodiment, the exit channel 504 is configured to output the output flow of the fluid from a mated vessel (and optionally back to a coolant system). As depicted in FIG. 5, fluid is output via exit channel 504 from one or more aligned outlets 324 of the vessel 312. In an embodiment, the exit channel 504 is configured around the opening 412.

In an embodiment, the exit channel is a circumferential channel within the collar 406. For example, the exit channel 504 can be configured around the opening 412. A circumferential exit channel 504 can output fluid from around an adjacent portion of the body of the vessel that has outlets 324 provided in a spaced and circumferential configuration. If the outlets 324 to the temperature regulating lines of the vessel are positioned radially, such as shown in FIG. 10, the circumferential exit channel 504 can output fluid from each outlet 324 and thus from a regulating channel of the vessel. The design is compact and reduces costs associated with machining a vessel. It also allows for different outlet configurations as well; that is, like the inlets 322, the outlets 324 of the regulating channels can be provided at different radial positions because despite the angles of the outlets 324 (relative to the regulating channels in the vessel), the outlets 324 can output fluid via the collar 406, so as long as the delivery exit 504 and the outlets 324 are positioned for alignment when the vessel is sealed within the collar 406.

Figure 8:
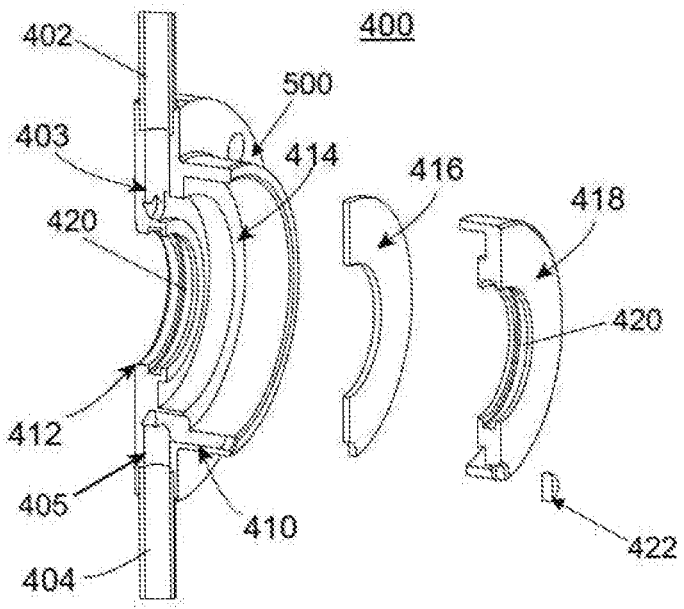
FIG. 8 illustrates an exploded plan view of the device in accordance with an embodiment.

The body 500 can have a first portion 410 and a second portion 418, as shown in FIG. 8, that are assembled together to form the collar 406. First portion 410 can include exit channel 504 as well as a portion of delivery channel 502. As shown in FIG. 9, in an embodiment, the delivery channel 502 may be on a front side (on a right side, as seen in this sectional view) of the collar 406 and the exit channel 504 may be on a back side (on a left side, as seen in this sectional view) of the collar 406. However, the placement of the delivery and exit channels 502, 504 within the collar 406 is not limiting. A position of the delivery channel 502 and/or exit channel 504 within the collar 406 can be based on a position of inlets 322 and outlets 324 on the vessel 312.

When the collar 406 includes both delivery and exit channels 502, 504 in its body 500, the delivery channel 502 and exit channel 504 can be offset or staggered relative to one another within the collar 406. In an embodiment, the channels 502 and 504 can be provided in a stepped configuration. In an embodiment, the channels 502 and 504 may be different sizes.

To prevent mixing of the input flow and output flow of fluid, a divider 416 is provided between the delivery channel 502 and the exit channel 504, shown in FIG. 9. In an embodiment, the body 500 can have channels 502, 504 in a stepped configuration to separate the channels 502, 504. For example, FIG. 8 shows a wall 414 or lip in first portion 410. The wall 414 provides the step or surface separating the delivery channel 502 and the exit channel 504. The divider 416 can be placed against this wall 414 and secured to the first portion 410 to close and thus form exit channel 504.

FIG. 8 shows a sectional view of an embodiment wherein the divider 416 is in the form of a ring. The ring has a central opening therein. The central opening of the ring axially aligns with the opening 412 of the collar 406. The central opening is configured to receive the vessel 312 therethrough when mated with the collar 406, as shown in FIG. 5.

The second portion 418 acts as a cap and can include a portion of delivery channel 502. The cap can close and thus form the delivery channel 502. In assembly, after insertion and securement of the divider 416, the second portion 418 can be attached to the first portion 410. As seen in FIG. 9, an edge of the second portion 410 can be inserted into the first portion 410. The edge can abut the divider 416, for example. Faces of the second portion 418 and first portion 410 are aligned (e.g., on the right, as shown in FIG. 9). When the first and second portions 410 and 418 are assembled together, the delivery channel 502 is formed and the two channels 502 and 504 are divided from one another.

The methods for assembly of the parts of the collar 406 are not intended to be limited. In an embodiment, one or more of the parts are welded together.

The first and second portions 410 and 418 of the collar 406 allow for easier manufacturing, machining, and assembly of its parts (e.g., forming staggered channels in the body). However, the depiction of first and second portions 410 and 418 and assembly of the collar 406 is not intended to be limiting. In an embodiment, for example, the divider 416 can be formed with and/or attached to a first portion with the delivery channel. A second portion may include an exit channel. The portions can then be secured together. In an embodiment, the collar 406 is formed a single, solid piece. The collar 406 may be formed or molded, for example. As such, it should be understood that any number of methods may be used to manufacture or machine the features of the device 400.

As shown in FIG. 9, the collar 406 can include one or more grooves 420 for receiving seals. For example, O-rings can be placed in the grooves 420. In an embodiment, the seals or O-rings can be used to secure and seal off an adjacent channel 502 or 504 (so that fluid is not lost). In an embodiment, the seals or O-rings can additionally, or alternatively, secure the body of the vessel 312 in place when inserted through the opening 412.

The device 400 can also include an inlet port 403 and/or outlet port 405. In this disclosure, "port" is defined as an opening for the passage of fluid. The inlet port 403 is fluidly connected with the delivery channel 502 to deliver the input flow of fluid. FIG. 9 shows a non-limiting embodiment wherein the inlet port 403 can be integrally formed with the collar 406.

In an embodiment, the inlet port 403 is positioned radially relative to the opening 412 through the collar 406. The inlet port 403 can be directly or indirectly connected to the delivery channel 502. As shown in FIG. 9, the collar 406 can include a directional channel for changing the direction of flow of the fluid from the input port 403 for delivery of fluid to the delivery channel 502. This direction channel can be provided in a substantially perpendicular (e.g., horizontal) configuration relative to the delivery channel 502 or the inlet port 403, for example, to connect the two fluidly. To seal the fluid within the delivery channel 502 of the collar 406, a plug 422, as shown in FIGS. 8 and 9, can be provided. The plug 422 can be inserted and secured (e.g., via welding) in an area or opening between a wall of the second portion 418 and a wall of the first portion 410, as shown in FIG. 8. FIG. 9 shows the plug 422 assembled in the body 500.

The directional channel and plug 422, however, need not be provided in collar 406. In accordance with an embodiment, an angled channel can be used to deliver the fluid via input port 403 to delivery channel 502. The angle of the input port 403 for delivering fluid is not limiting.

In an embodiment wherein the collar 406 includes the exit channel 504, an outlet portion 405 can also be included. The outlet port 405 is fluidly connected with the exit channel 504 to output the output flow of fluid. In a non-limiting embodiment, the outlet port 405 can be integrally formed with the collar 406, as shown in FIG. 9.

In an embodiment, the outlet port 405 is positioned radially relative to the opening 412 through the collar 406. The outlet port 405 can be directly or indirectly connected to the exit channel 504. The angle of the outlet port 405 for delivering fluid is not limiting.

In an embodiment, the exit channel 504 and outlet port 405 are configured to direct the output flow of fluid from the vessel in a substantially upward direction out of the collar 406. For example, the outlet port 405 can be provided at or near a top portion of the collar 406. By directing the output flow in this manner, it aids in avoiding air bubbles from forming and/or getting caught in the collar 406 and/or outlet port 405 (and output line 402, described below).

The inlet port 403 and/or outlet port 405 can be connected to an input line 404 and/or output line 402, shown in FIG. 6 and FIG. 7. Ends of the input line 404 and/or output line 402 can connect to tubes extending to/from a coolant system, for example, to communicate the fluid to/from the lines 404, 402. In an embodiment, the input line 404 and/or output line 402 can extend away from the collar 406. In an embodiment, the input line 404 and/or output line 402 are positioned in a vertical direction. However, the positioning of the input line 404 and/or output line 402 is not limited. As shown in FIG. 4, the input line 404 and/or output line 402 can be received between the mold 340 and transfer sleeve 350 of the apparatus 300 when mounted therein. The positioning of the lines 404, 402 can be determined based on a location of the tubes of the coolant system.

When the device 400 is provided and used in an apparatus, such as injection molding apparatus 300, the delivery channel 502 is configured to deliver the input flow of the fluid into the vessel via the aligned channel 502 and inlets 322. Fluid can be input from tubes of the coolant system 360 via input line 404 and into input port 405. Fluid then flows into the delivery channel 502 and into the temperature regulating channels of the vessel 316 via inlets 322. Fluid can flow out of the channels of the vessel 316 via outlets 324 and output through the exit channel 504 and outlet port 403. Fluid can be delivered back to the coolant system 360 via directing the output flow through the output line 402 and tubes.

Accordingly, in addition to the features and benefits previously described, the above described embodiments assist in delivering fluid from a coolant system to at least a vessel in an inline, injection molding apparatus. This disclosure allows for cold-crucible shot-sleeve (i.e., vessel 312) to be fed with water (or any temperature stabilizing liquid such as water, radiator fluids, hot oil, etc.) at any radial point. Inlet holes 322 and/or outlet holes 324 can be drilled into the vessel 312 at any points along and in alignment with the channels 502, 504. The staggered hole pattern allows inlets 322 to be fed with fluid independently and at any angular position. Angled turns of the inlets 322 and outlets 324 are eliminated.

Further, the vessel 312 can be formed so that fluid (coolant) can easily be directed down specific channels and returned along specific channels. This allows the fluid to be distributed to areas expected to heat the most, e.g., the melting portion 314, thereby providing the most uniform heating (or cooling) to the vessel. The device 400 also allows for a smaller stock material size to be used when machining the vessel. Systems that have a face seal require a large flange on the vessel. This requires using stock having the same diameter as the flange and machining a large volume off to achieve the minor diameter. With device 400, stock can be used having the same minor diameter as the vessel. A smaller stock is less expensive, and, therefore, use of a smaller stock to machine the vessel lowers consumable costs. Additionally, machining of the vessel is simplified and several operations to plug drill holes are eliminated. It does not require multiple (e.g., at least four) drilling and brazing operations to connect inlet and outlet lines, for example. Brazing and welding operations are expensive and may even compromise the mechanical properties of the vessel by heat treatment of the material/stock being used to form it. Using a vessel with the device 400 as disclosed herein can reduce overall costs as well as reduce heat treatment effects. Further, a larger volume of fluid can be forced through the vessel since flow restrictions other than angled turns are substantially eliminated from the vessel design.

Although the device 400 and its design could be used to regulate the temperature of a cold crucible or vessel 312 (e.g., to heat the vessel) as described previously, its application is not limited. In embodiments, the device 400 may be used to: run heating fluid through a die-casting shot sleeve, run cooling fluid through a die-casting shot sleeve, and run heating fluid through a cold crucible/vessel to stabilize the vessel's surface or melting portion 314 at a higher temperature, thus reducing cooling of the molten alloy and achieving a higher overheat temperature.

Further, the combination of the device and vessel as disclosed herein to reduce the length of the vessel and the injection molding apparatus, while still getting the molten material as close to the mold as possible prior to injection, to reduce any heat loss from the molten material as it is transferred. It also reduces the complexity and cost of making the various components of the machine, like consumable components such as the vessel. It provides a more compact design overall, simpler machining steps, and easier assembly and replacement.

In accordance with an embodiment, this disclosure enables the use of a commercially viable silver-boat type melt system, such as when that melt system is part of an inline injection system. Silver boats are commonly used to alloy reactive metals in small quantities. Typically, a copper tube is deformed (dented) and placed inside an induction coil so that materials can be melted in the concave dented region, and water can pass through the tubing allowing constant cooling of the boat so that it does not melt or react with the material being alloyed. These silver boats are effective for test melting small volumes of reactive alloys in a lab-scale environment, but do not lend themselves to a production system because they are not designed for mechanical stability over thousands of melts, or designed for precision and repeatability at low cost of manufacturing. This disclosure provides a design for a robust, repeatable, method of delivering coolant to a production quality silver boat through a manifold.

The meltable material can be received in the melt zone in any number of forms. For example, the meltable material may be provided into the melt zone in the form of an ingot (solid state), a semi-solid state, a slurry that is preheated, powder, pellets, etc. In some embodiments, a loading port (such as the illustrated example of an ingot loading port 318 in FIG. 3) may be provided as part of injection molding apparatus 300. Loading port 318 can be a separate opening or area that is provided within the machine at any number of places. In an embodiment, loading port 318 may be a pathway through one or more parts of the machine. For example, the material (e.g., ingot) may be inserted in a horizontal direction into the vessel 312 by plunger 330, or may be inserted in a horizontal direction from the mold side of the injection apparatus 300 (e.g., through mold 340 and/or through an optional transfer sleeve 350 into vessel 312). In other embodiments, the meltable material can be provided into the melt zone in other manners and/or using other devices (e.g., through an opposite end of the injection apparatus).

In accordance with an embodiment, after the material is melted in the vessel 312, plunger 330 may be used to force the molten material from the vessel 312 and into a mold 340 for molding into an object, a part or a piece. In instances wherein the meltable material is an alloy, such as an amorphous alloy, the mold 340 is configured to form a molded bulk amorphous alloy object, part, or piece. Mold 340 has an inlet for receiving molten material there-through. An output of the vessel 312 (e.g., second or back end that is used for injection) and an inlet of the mold 340 can be provided in-line and on a horizontal axis such that plunger rod 330 is moved in a horizontal direction through body of the vessel 312 to inject molten material into the mold 340 via its inlet.

As previously noted, systems such as injection molding system 300 that are used to mold materials such as metals or alloys may implement a vacuum when forcing molten material into a mold or die cavity. Injection molding system 300 can further include at least one vacuum source or pump (not shown) operatively connected thereto that is configured to apply vacuum pressure to at least vessel 312 in the melt zone and to mold 340 via vacuum ports 333, shown in FIG. 3. The vacuum pressure may be applied to at least the parts of the injection molding system 300 used to melt, move or transfer, and mold the material therein. For example, the vessel 312 and plunger rod 330 may be under vacuum pressure and/or enclosed in a vacuum chamber during melting and molding processes.

In an embodiment, mold 340 is a vacuum mold that is an enclosed structure configured to regulate vacuum pressure therein when molding materials. For example, in an embodiment, vacuum mold 340 includes a first plate (also referred to as an "A" mold or "A" plate), a second plate (also referred to as a "B" mold or "B" plate) positioned adjacently (respectively) with respect to each other. The first plate and second plate generally each have a mold cavity associated therewith for molding melted material there-between. The mold cavities may include a part cavity for forming and molding a part, such as a BMG part, therein.

In an embodiment, the cavities of the mold 340 are configured to mold molten material received there-between via an optional injection sleeve or transfer sleeve 350 from the melt zone. Generally, the first plate of mold 340 may be connected to transfer sleeve 350. Transfer sleeve 350 (sometimes referred to as a shot sleeve, a cold sleeve or an injection sleeve in the art and herein) may be provided between melt zone 310 and mold 340. Transfer sleeve 350 has an opening that is configured to receive and allow transfer of the molten material there-through and into mold 340 (using plunger 330). Its opening may be provided in a horizontal direction along the horizontal axis (e.g., X axis). The transfer sleeve need not be a cold chamber. In an embodiment, at least plunger rod 330, vessel 312 (e.g., inner wall of its receiving or melting portion), and opening of the transfer sleeve 350 are provided in-line and on a horizontal axis, such that plunger rod 330 can be moved in a horizontal direction through the body of the vessel 312 in order to move the molten material from the vessel 312 and into (and subsequently through) the opening of transfer sleeve 350, and into mold 340. Transfer sleeve 350 may also be under vacuum pressure and/or enclosed in a vacuum chamber during melting and molding processes.

Molten material is pushed in a horizontal direction through transfer sleeve 350 and into the mold cavity(ies) via the inlet (e.g., in a first plate) and between the first and second plates. During molding of the material, the at least first and second plates are configured to substantially eliminate exposure of the material (e.g., amorphous alloy) there-between, e.g., to oxygen and nitrogen. Specifically, a vacuum is applied such that atmospheric air is substantially eliminated from within the plates and their cavities. A vacuum pressure is applied to an inside of vacuum mold 340 using at least one vacuum source that is connected via vacuum lines and ports 333. For example, the vacuum pressure or level on the system can be held between $1\times10^{-1}$ to $1\times10^{-4}$ Torr during the melting and subsequent molding cycle. In another embodiment, the vacuum level is maintained between $1\times10^{-2}$ to about $1\times10^{-4}$ Torr during the melting and molding process. Of course, other pressure levels or ranges may be used, such as $1\times10^{-9}$ Torr to about $1\times10^{-3}$ Torr, and/or $1\times10^{-3}$ Torr to about 0.1 Torr. An ejector mechanism (not shown) is configured to eject molded (amorphous alloy) material (or the molded part) from the mold cavity between the first and second plates of mold 340. The ejection mechanism is associated with or connected to an actuation mechanism (not shown) that is configured to be actuated in order to eject the molded material or part (e.g., after first and second parts and are moved horizontally and relatively away from each other, after vacuum pressure between at least the plates is released).

Any number or types of molds may be employed in the apparatus 300. For example, any number of plates may be provided between and/or adjacent the first and second plates to form the mold. Molds known in the art as "A" series, "B" series, and/or "X" series molds, for example, may be implemented in injection molding system/apparatus 300.

A uniform heating of the material to be melted and maintenance of temperature of molten material in such an injection molding apparatus 300 assists in forming a uniform molded part. For explanatory purposes only, throughout this disclosure material to be melted is described and illustrated as being in the form of an ingot 305 that is in the form of a solid state feedstock; however, it should be noted that the material to be melted may be received in the injection molding system or apparatus 300 in a solid state, a semi-solid state, a slurry that is preheated, powder, pellets, etc., and that the form of the material is not limiting.

It should be noted that the device 400 and its parts disclosed herein may be formed from any number of materials and is not intended to be limiting. For example, device 400 can be formed from or include a stainless steel or some corrosion resistant material is capable of having fluid (e.g., water or other coolant current) run through it. Such material should be strong as well, because it can be subject to the force of some of the injection on the face of the vessel. As noted previously, back pressure can be applied to the vessel, which is held by its flange 326. Back pressure can also be applied to device 400 in the apparatus. The device 400 aids in keeping the vessel in its forward position by applying a force on the flange 326 on the vessel 312.

Also, the body of vessel 312 in any of the embodiments disclosed herein may be formed from any number of materials (e.g., copper, silver, and alloys), include one or more coatings or layers on any of the surfaces or parts thereof, and/or configurations or designs. The material(s) used to form a vessel body, the material(s) to be melted, and layer(s) of material are not meant to be limiting.

Although not described in great detail, the disclosed injection system may include additional parts including, but not limited to, one or more sensors, e.g., temperature sensor 362, flow meters, etc. (e.g., to monitor temperature, cooling water flow, etc.), and/or one or more controllers 364. The material to be molded (and/or melted) using any of the embodiments of the injection system as disclosed herein may include any number of materials and should not be limited. In one embodiment, the material to be molded is an amorphous alloy, as described above.

Applications of Embodiments

The presently described apparatus and methods can be used to form various parts or articles, which can be used, for example, for Yankee dryer rolls; automotive and diesel engine piston rings; pump components such as shafts, sleeves, seals, impellers, casing areas, plungers; Wankel engine components such as housing, end plate; and machine elements such as cylinder liners, pistons, valve stems and hydraulic rams. In embodiments, apparatus and methods can be used to form housings or other parts of an electronic device, such as, for example, a part of the housing or casing of the device or an electrical interconnector thereof. The apparatus and methods can also be used to manufacture portions of any consumer electronic device, such as cell phones, desktop computers, laptop computers, and/or portable music players. As used herein, an "electronic device" can refer to any electronic device, such as consumer electronic device. For example, it can be a telephone, such as a cell phone, and/or a land-line phone, or any communication device, such as a smart phone, including, for example an iPhone™, and an electronic email sending/receiving device. It can be a part of a display, such as a digital display, a TV monitor, an electronic-book reader, a portable web-browser (e.g., iPad™), and a computer monitor. It can also be an entertainment device, including a portable DVD player, DVD player, Blu-Ray disk player, video game console, music player, such as a portable music player (e.g., iPod™), etc. It can also be a part of a device that provides control, such as controlling the streaming of images, videos, sounds (e.g., Apple TV™), or it can be a remote control for an electronic device. It can be a part of a computer or its accessories, such as the hard driver tower housing or casing, laptop housing, laptop keyboard, laptop track pad, desktop keyboard, mouse, and speaker. The coating can also be applied to a device such as a watch or a clock.

While the invention is described and illustrated here in the context of a limited number of embodiments, the invention may be embodied in many forms without departing from the spirit of the essential characteristics of the invention. The illustrated and described embodiments, including what is described in the abstract of the disclosure, are therefore to be considered in all respects as illustrative and not restrictive. The scope of the invention is indicated by the appended claims rather than by the foregoing description, and all changes that come within the meaning and range of equivalency of the claims are intended to be embraced therein.

What is claimed is:

1. An apparatus comprising:

a vessel configured to receive a material for melting therein;

a heat source for melting the material in the vessel, the heat source comprising an induction source;

a coolant system; and a fluid delivery device for delivering fluid from the coolant system, wherein the fluid delivery device comprises a collar having an opening extending therethrough and a delivery channel within the collar for directing an input flow of the fluid, an inlet port fluidly connected to the delivery channel, and a directional channel fluidly connecting the delivery channel and the inlet port within the collar for changing the direction of the fluid from the inlet port to the delivery channel, wherein the directional channel is located in a circular portion of the collar, wherein the delivery channel is configured to deliver the input flow of the fluid into the vessel, wherein the vessel is provided in the opening of the collar and sealed thereto, and wherein the vessel comprises one or more temperature regulating channels configured to flow the fluid therein received by the delivery channel for regulating a temperature of the vessel during melting of the material by the heat source.

2. The apparatus of claim 1, wherein the fluid delivery device further comprises an exit channel within the collar for directing an output flow of the fluid, and wherein the exit channel is configured to output the output flow of the fluid from the temperature regulated vessel.

3. The apparatus of claim 2, wherein the delivery channel and the exit channel are circumferential channels within the collar, and wherein the delivery channel and the exit channel are each configured around the opening.

4. The apparatus of claim 3, further comprising a divider between the delivery channel and the exit channel within the collar for preventing mixing of the input flow and the output flow of fluid.

5. The apparatus of claim 4, wherein the divider is in the form of a ring, the ring having a central opening therein, wherein the central opening of the ring axially aligns with the opening of the collar, and wherein the central opening is configured to receive the vessel therethrough.

6. The apparatus of claim 2, wherein the delivery channel and exit channel are offset relative to one another within the collar.

7. The apparatus of claim 1, wherein the apparatus is an injection molding apparatus further comprising a mold, wherein the mold is configured to receive molten material from the vessel and to mold the molten material into a part; and wherein the fluid delivery device is attached to the mold.

8. The apparatus of claim 1, wherein the induction source comprises an induction coil.

9. A method, comprising:

delivering fluid from a coolant system to a fluid delivery device;

directing the fluid using the fluid delivery device to an end of a vessel;

operating a heat source provided adjacent to the vessel to heat a meltable material therein, the heating source comprises an induction source; and regulating a temperature of the vessel by flowing the fluid within the vessel;

wherein the fluid delivery device comprises a collar having an opening extending therethrough and a circumferential delivery channel within the collar for directing an input flow of the fluid, an inlet port fluidly connected to the delivery channel, and a directional channel fluidly connecting the delivery channel and the inlet port within the collar for changing the direction of the fluid from the inlet port to the delivery channel, wherein the directional channel is located in a circular portion of the collar, wherein the delivery channel is configured to deliver the input flow of the fluid into the vessel, wherein the vessel is provided in the opening of the collar and sealed thereto, and wherein the vessel comprises one or more temperature regulating channels configured to flow the fluid therein received by the delivery channel for regulating a temperature of the vessel during the operation of the heat source.

10. The method of claim 9, wherein the fluid delivery device further comprises an exit channel within the collar for directing an output flow of the fluid, wherein the exit channel is configured to output the output flow of the fluid from the vessel, and wherein the method further comprises: directing the output flow of the fluid from the vessel to the coolant system using the fluid delivery device.

11. The method of claim 10, wherein the delivery channel and exit channel are offset relative to one another within the collar and wherein the end of the vessel comprises a fluid receiving inlet and a fluid outlet for the one or more temperature regulating channels;

wherein the directing the fluid using the fluid delivery device to the end of the vessel further comprises directing the fluid into the fluid receiving inlet in the end of the vessel, and wherein the directing the output flow of the fluid from the vessel to the coolant system further comprises receiving the output flow of fluid from the fluid outlet in the end of the vessel.

12. The method of claim 9, wherein the induction source comprises an induction coil.

13. The method of claim 9, wherein the delivery channel and the exit channel are circumferential channels within the collar, and wherein the delivery channel and the exit channel are each configured around the opening.

14. The method of claim 13, further comprising a divider between the delivery channel and the exit channel within the collar for preventing mixing of the input flow and the output flow of fluid.

15. The method of claim 14, wherein the divider is in the form of a ring, the ring having a central opening therein, wherein the central opening of the ring axially aligns with the opening of the collar, and wherein the central opening is configured to receive the vessel therethrough.

* * * * *